US009925786B2

(12) United States Patent
Niiyama

(10) Patent No.: US 9,925,786 B2
(45) Date of Patent: Mar. 27, 2018

(54) REMAINING AMOUNT OF INK DISPLAY APPARATUS, PRINTING SYSTEM

(71) Applicant: SEIKO EPSON CORPORATION, Tokyo (JP)

(72) Inventor: Shinichiro Niiyama, Sapporo (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/991,633

(22) Filed: Jan. 8, 2016

(65) Prior Publication Data

US 2016/0200115 A1 Jul. 14, 2016

(30) Foreign Application Priority Data

Jan. 14, 2015 (JP) ..... 2015-004921
Jan. 14, 2015 (JP) ..... 2015-004922

(51) Int. Cl.
*B41J 2/175* (2006.01)
*B41J 2/165* (2006.01)

(52) U.S. Cl.
CPC ..... *B41J 2/17566* (2013.01); *B41J 2/1752* (2013.01); *B41J 2/17509* (2013.01); *B41J 2/16508* (2013.01); *B41J 2/16532* (2013.01); *B41J 2/16535* (2013.01); *B41J 2/17503* (2013.01); *B41J 2002/17569* (2013.01); *B41J 2002/17589* (2013.01)

(58) Field of Classification Search
CPC .... B41J 2002/17589; B41J 2002/17569; B41J 2/17566; B41J 2/17569
See application file for complete search history.

(56) References Cited

U.S. PATENT DOCUMENTS 5,802,420 A * 9/1998 Garr ..... B41J 2/17566 347/19
6,430,711 B1 * 8/2002 Sekizawa ..... G06F 11/3006 358/1.14
7,438,370 B2 * 10/2008 Motominami ..... B41J 2/1752 347/5
8,147,021 B2 * 4/2012 Nishizaka ..... B41J 2/17509 347/101
2003/0020951 A1 * 1/2003 Minowa ..... B41J 2/17566 358/1.15
2012/0050359 A1 * 3/2012 Koganehira ..... B41J 2/17509 347/6

(Continued)

FOREIGN PATENT DOCUMENTS

JP 2002-283670 A 10/2002
JP 2003-175590 A 6/2003

(Continued)

*Primary Examiner* — Sharon A Polk
(74) *Attorney, Agent, or Firm* — Foley & Lardner LLP

(57) ABSTRACT

A remaining amount of ink display apparatus includes a printing executing section which executes printing by discharging ink that is retained in a retaining section, a consumption amount acquiring section which acquires an amount of ink consumption used in printing executed by the printing executing section based on a print job, a remaining amount acquiring section which acquires a remaining amount of ink in the retaining section, a display section which displays information, and a display control section which displays the amount of ink consumption and the remaining amount of ink on the display section.

14 Claims, 16 Drawing Sheets

(56) References Cited

U.S. PATENT DOCUMENTS

| | | | | |
|---|---|---|---|---|
| 2013/0106968 | A1* | 5/2013 | Matsumoto | B41J 2/17546 347/104 |

FOREIGN PATENT DOCUMENTS

| | | | | |
|---|---|---|---|---|
| JP | 2005-096250 | A | | 4/2005 |
| JP | 2005169939 | A | * | 6/2005 |
| JP | 2007-181957 | A | | 7/2007 |
| JP | 2007-304650 | A | | 11/2007 |
| JP | 2008071081 | A | * | 3/2008 |
| JP | 2011-037275 | A | | 2/2011 |
| JP | 2011-136426 | A | | 7/2011 |
| JP | 2012-206455 | A | | 10/2012 |

* cited by examiner

| TIMING | INK STATUS WINDOW |
|---|---|
| Td1 |  |
| Td2 |  |
| Td3 |  |
| Td4 |  |
| Td5 |  |

REMAINING AMOUNT OF INK DISPLAY APPARATUS, PRINTING SYSTEM

BACKGROUND

1. Technical Field

The invention relates to a printing technique in which printing is performed by discharging ink.

2. Related Art

JP-A-2007-181957 describes an ink jet printer which performs printing using ink which is discharged from a nozzle. The printer has an aggregate display screen which indicates apparatus information, and displays on the aggregate display screen by calculating the amount of ink which is used in the aggregate period (one day, one week, or one month) which is specified by the user from a printing stage number and a character size.

In such a printer, it is necessary to replace a cartridge when ink in the cartridge is used up. For this reason, there is a need by the user to simply determine a period at which it is necessary to replace the cartridge before the ink is used up. In other words, there is a need by the user to simply determine whether or not it is necessary to replace the cartridge or refill the ink before starting printing which is prearranged to be executed. However, the technique in JP-A-2007-181957 cannot be said to sufficiently respond to such a need of the user.

SUMMARY

An advantage of some aspects of the invention is to provide a technique which makes it possible for a user to simply determine whether or not it is necessary to replace the cartridge or refill the ink.

According to an aspect of the invention, there is provided a remaining amount of ink display apparatus including a printing executing section which executes printing by discharging ink that is retained in a retaining section, a consumption amount acquiring section which acquires an amount of ink consumption of ink which is retained in the retaining section, a remaining amount acquiring section which acquires a remaining amount of ink in the retaining section, a display section which displays information, and a display control section which displays the amount of ink consumption and the remaining amount of ink on the display section, in which the consumption amount acquiring section acquires the amount of ink which is consumed by printing executed at a reference time or after as the amount of ink consumption.

According to another aspect of the invention, there is provided a printing system including a printer which executes printing by discharging ink that is retained in a retaining section, and a control device which controls the printer, in which the control device has a consumption amount acquiring section which acquires an amount of ink consumption of ink which is retained in the retaining section, a remaining amount acquiring section which acquires a remaining amount of ink in the retaining section, a display section which displays information, and a display control section which displays the amount of ink consumption and the remaining amount of ink on the display section, in which the consumption amount acquiring section acquires the amount of ink which is consumed by printing executed at a reference time or after as the amount of ink consumption.

In the invention which is configured in such a manner (remaining amount of ink display apparatus, printing system), the amount of ink consumption in a cartridge is acquired while acquiring the amount of ink consumption due to printing that is executed based on a print job. Then, the amount of ink consumption and the remaining amount of ink are displayed on the display section. Accordingly, the user is able to simply determine whether or not it is necessary to replace the cartridge by estimating an amount of ink that is necessary for printing scheduled to be executed by confirming the amount of ink consumption in printing that was executed in the past using the display section and comparing the result to the remaining amount of ink on the display section.

Various specific forms for acquiring the amount of ink consumption are considered. For example, the remaining amount of ink display apparatus may be configured such that the consumption amount acquiring section acquires the amount of ink that is consumed by printing executed at a reference time or after as the amount of ink consumption.

Furthermore, the remaining amount of ink display apparatus may be configured so as to be provided with an input operation section which is able to execute an input operation, in which the consumption amount acquiring section sets the reference time according to the content of the input operation of the input operation section. Thereby, it is possible to arbitrary set the reference time by operating the input operation section. As a result, it is possible to more precisely correspond to the user's needs.

The remaining amount of ink display apparatus may be configured such that the consumption amount acquiring section is able to set a plurality of reference times which correspond to timings which are different from each other and acquires the amount of ink consumption of the respective plurality of reference times, and the display control section displays the amount of ink consumption and the remaining amount of ink of each of the plurality of reference times on the display section. Thereby, it is possible to ascertain the amount of ink consumption from the plurality of different reference times, and when an amount of ink that is necessary in printing which is scheduled to be executed is estimated, information which is able to be utilized by the user is enriched. As a result, the user is able to more precisely ascertain the amount of ink that is necessary in printing which is scheduled to be executed.

In addition, the remaining amount of ink display apparatus may be configured such that, in the printing executing section, a plurality of retaining sections are held, the consumption amount acquiring section is able to independently set the reference times from each other in at least two retaining sections out of the plurality of retaining sections and acquire the amount of ink consumption from the reference times that correspond to each retaining section, the remaining amount acquiring section acquires the remaining amount of ink from each retaining section, and the display control section displays the amount of ink consumption and the remaining amount of ink in each retaining section on the display section. With this configuration, it is possible to set the reference times independently from each other in at least two retaining sections, and it is possible to more widely correspond to the user's needs.

The remaining amount of ink display apparatus may be configured such that, in the printing executing section, the plurality of retaining sections are held, while being able to set common reference times in at least two specified retaining sections out of the plurality of retaining sections, the consumption amount acquiring section is able to independently set the reference times from specified retaining sections in the retaining sections other than the specified retaining sections and acquires the amount of ink consumption from the reference times that correspond to each retaining section, the remaining amount acquiring section acquires the remaining amount of ink from each retaining section, and the display control section displays the amount of ink consumption and the remaining amounts of ink in each retaining section on the display section. With this configuration, it is possible to set common reference times in at least two specified retaining sections, it is possible to set the reference times independently from the specified retaining sections in the retaining sections other than the specified retaining sections, and it is possible to more widely correspond to the user's needs.

The remaining amount of ink display apparatus may be configured such that the consumption amount acquiring section sets the reference times according to the content of the print job. With this configuration, since the reference times, that gives a timing at which acquisition of the amount of ink consumption is started, are set according to the content of the print job, the amount of ink consumption which is necessary for printing the content is displayed on the display section. Accordingly, it is possible to estimate the amount of ink that is necessary in printing which is scheduled to be executed while considering the content of the printing for which the amount of ink consumption is necessary that is displayed on the display section, and it is possible to more precisely ascertain the amount of ink which is necessary for printing which is scheduled to be executed.

In detail, the remaining amount of ink display apparatus may be configured such that, in a case where the number of sheets to be printed that is indicated in the print job is a predetermined number or more, the consumption amount acquiring section sets the reference times according to the timing at which printing is started based on the print job. Alternatively, the remaining amount of ink display apparatus may be configured such that, in a case where ink of a specific color is used in printing that is indicated in the print job, the consumption amount acquiring section sets the reference times according to the timing at which printing is started based on the print job.

That is, various specific forms are considered for displaying the amount of ink consumption and the remaining amount of ink on the display section. For example, the remaining amount of ink display apparatus may be configured such that the display control section displays the amount of ink consumption and the remaining amount of ink together on the same window. Alternatively, the remaining amount of ink display apparatus may be configured such that the display control section displays the amount of ink consumption and the remaining amount of ink separately on different windows.

According to still another aspect of the invention there is provided a remaining amount of ink display apparatus including a printing executing section which executes printing by discharging ink that is retained in a retaining section, a display section which displays information, and a display control section which is able to display a first indicator which indicates a remaining amount of ink of the retaining section at specified times and a second indicator which indicates a change over time of the remaining amount of ink of the retaining section on the display section.

In the remaining amount of ink display apparatus of the invention configured in this manner, the remaining amount of ink of the retaining section at specified times and the change over time of the remaining amount of ink of the retaining section are indicated on the display section. Accordingly, the user is able to ascertain the pace of ink consumption from the change over time of the remaining amount of ink, and is able to determine whether or not it is necessary to replace the cartridge or refill the ink when a certain time has passed from the specified time based on the ascertained pace of ink consumption and the remaining amount of ink at the specified time. Thereby, it is possible for the user to simply determine a period for replacing the cartridge or refilling the ink.

The remaining amount of ink display apparatus may be configured such that the display control section selectively executes at least one of a first mode in which the second indicator is not displayed while the first indicator is displayed and a second mode in which the first indicator and the second indicator are displayed. With this configuration, in a case where the display of the second indicator is unnecessary, the first mode is executed, in a case where display of the second indicator is necessary, the second mode is executed, and it is possible to control display according to the necessity of display of the second indicator.

At this time, the remaining amount of ink display apparatus may be configured such that the display control section carries out a pop-up display of the second indicator accompanying a switch from the first mode to the second mode.

The remaining amount of ink display apparatus may be configured such that in the second mode, the first indicator is displayed without overlapping with a predetermined range while the second indicator is displayed in the predetermined range, and in the first mode, the second indicator is not displayed while the first indicator is displayed to overlap with the predetermined range. With this configuration, in the second mode, since the first and second indicators are displayed so as not to overlap with each other, it is possible to secure visibility of the first and second indicators. Meanwhile, in the first mode, the first indicator is displayed to overlap with the predetermined range in which the second indicator is displayed in the second mode. Accordingly, in the first mode, it is possible to effectively utilize the predetermined range in the display of the first indicator.

In addition, the remaining amount of ink display apparatus may be configured such that the display control section displays the first indicator to be smaller in the second mode than in the first mode. With this configuration, in the first mode, it is possible to improve visibility of the first indicator by displaying the first indicator to be large, and in the second mode, it is possible to improve visibility of the second indicator by securing a display range (the predetermined range) of the second indicator.

The remaining amount of ink display apparatus may be configured such that in the printing executing section, a plurality of retaining sections are held, and the display control section displays a plurality of the first indicators, which indicate the remaining amount of ink of different retaining sections, in the first mode.

The remaining amount of ink display apparatus may be configured so as to include an input operation section which receives a selection operation in which one first indicator is selected from the plurality of first indicators during display in the first mode, and the display control section displays the change over time of the remaining amount of ink in the retaining section which corresponds to the one first indicator selected in the selection operation using the second indicator by switching from the first mode to the second mode when the selection operation is input to the input operation section. With this configuration, it is possible to confirm the second indicator which indicates the change over time of the remaining amount of ink in a desired retaining section by displaying in the display section by performing the selection operation in which the first indicator that corresponds to the retaining section for which the change over time of the remaining amount of ink is desired to be known is selected during the display of the first mode.

That is, various details of the selection operation are considered. That is, in a case where the input operation section has a mouse, the operation in which a click or mouse hover is performed with respect to the first indicator that indicates the remaining amount of ink of the desired retaining section is able to be determined as the selection operation. Alternatively, in a case where the input operation section has a touch panel, the operation in which a tap or a long press is performed with respect to the first indicator that indicates the desired remaining amount of ink is able to be determined as the selection operation.

Alternatively, the remaining amount of ink display apparatus may be configured so as to be provided with the input operation section which receives a switching operation in which switching from the first mode to the second mode during execution of the first mode is requested, and the display control section displays the change over time of the remaining amount of ink in the plurality of retaining sections using the second indicator by switching from the first mode to the second mode when the switching operation is input to the input operation section. With this configuration, it is possible to execute switching from the first mode to the second mode at an arbitrary timing in order to confirm the change over time of the remaining amount of ink.

That is, various details of the switching operation are considered. That is, in a case where the input operation section has a mouse, the operation in which a click or mouse hover is performed with respect to the first indicator is able to be determined as the switching operation. Alternatively, in a case where the input operation section has a touch screen, the operation in which a tap or a long press is performed with respect to the first indicator is able to be determined as the switching operation.

In addition, the remaining amount of ink display apparatus may be configured such that the display control section displays the second indicator on the display section without overlapping with the first indicator. With this configuration, since the first and second indicators are displayed so as not to overlap with each other, it is possible to secure visibility of the first and second indicators.

In addition, the remaining amount of ink display apparatus may be configured such that the printing executing section executes printing according to the print job that indicates the printing content, and the display control section sets display forms of the change over time of the remaining amount of ink in the second indicator to be different in each print job. With this configuration, it is possible to simply ascertain the pace of consumption of ink in each print job based on the difference of the display forms. Accordingly, it is possible to more precisely ascertain a period at which it is necessary to replace the retaining section accompanying the print job which is subsequently executed.

In addition, the remaining amount of ink display apparatus may be configured such that the display control section is able to execute a mode in which the second indicator is indicated in a separate window from a window in which the first indicator is indicated. With this configuration, it is possible to simply enlarge and display the second indicator by displaying the window on which the second indicator is indicated on the entire screen or the like.

Here, various specific configurations of the first indicator are considered. Therefore, the remaining amount of ink display apparatus may be configured such that the first indicator displays the remaining amount of ink of the retaining section at the specified time using the length of a bar.

In addition, various specific configurations of the second indicator are considered. Therefore, the remaining amount of ink display apparatus may be configured such that the second indicator displays by plotting the remaining amount of ink of the retaining section in a graph that gives the remaining amount of ink of the retaining section on a vertical axis while giving time on a horizontal axis.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
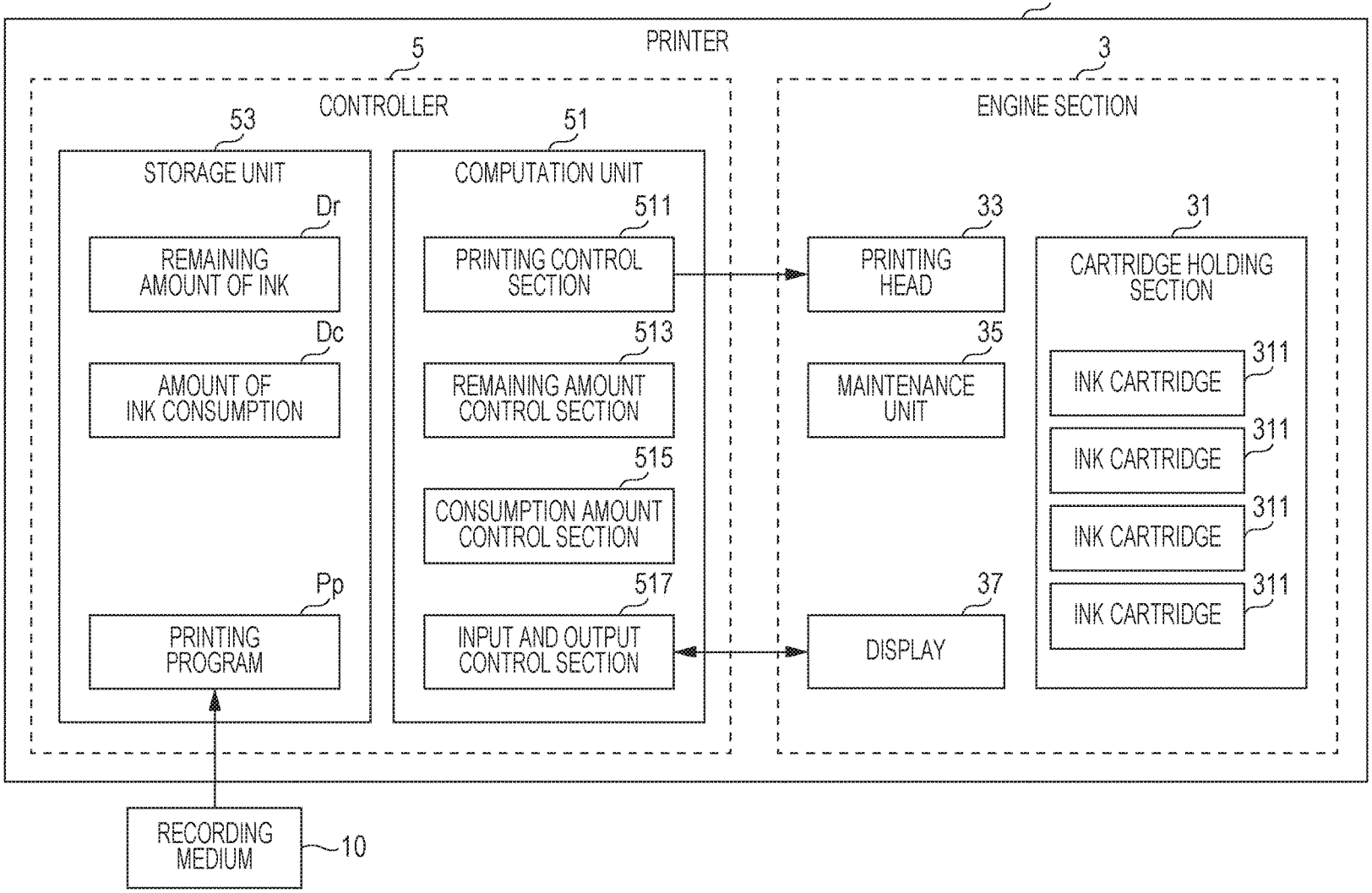
FIG. 1 is a block diagram illustrating a configuration according to a first embodiment of a printer as an example of a remaining amount of ink display apparatus to which the invention can be applied.

FIG. 1 is a block diagram illustrating a configuration according to a first embodiment of a printer as an example of a remaining amount of ink display apparatus to which the invention can be applied. Here, in FIG. 1, a recording medium 10 which is, for example, a digital versatile disc (DVD), a universal serial bus (USB) memory, and the like is shown other than in a printer 1. As shown in FIG. 1, the printer 1 has an engine section 3 which is a mechanical configuration of the printer 1, and a controller 5 which is an electrical configuration which controls the engine section 3. The engine section 3 of the printer 1 discharges ink in a web using an ink jet system, and is provided with the same configuration as the mechanical configuration of the printer which is indicated in, for example, JP-A-2014-180805, JP-A-2013-997, or the like.

The engine section 3 has a cartridge holding section 31 which holds an ink cartridge 311 which is an ink retaining section to be attachable and detachable. A plurality of ink cartridges 311 are mounted in the cartridge holding section 31. The ink cartridges 311 respectively retain ink of different colors from each other, for example, in the embodiment ink of yellow (Y), magenta (M), cyan (C), and black (K). Furthermore, the engine section 3 has a printing head 33 which discharges ink from a nozzle using the ink jet system, and the printing head 33 discharges ink which is supplied from the ink cartridge 311 in a web. Thereby, printing is executed.

In addition, the engine section 3 has a maintenance unit 35 which executes maintenance of the printing head 33. The maintenance is capping, cleaning, and wiping. Capping is a process in which the printing head 33 is covered by a cap. By this capping it is possible to control ink viscosity within the nozzle of the printing head 33 to be increased. Cleaning is a process in which ink is forcefully discharged from the nozzle of the printing head 33 by generating negative pressure within the cap while capping the printing head 33. By this cleaning, ink in which viscosity is increased, bubbles within the ink, and the like are able to be removed from the nozzle of the printing head 33. Wiping is a process in which an opening of the nozzle in the printing head 33 is wiped on an arrangement surface (nozzle formation surface) using a wiper. By this wiping it is possible to wipe ink from the nozzle formation surface of the printing head 33.

Figure 2:
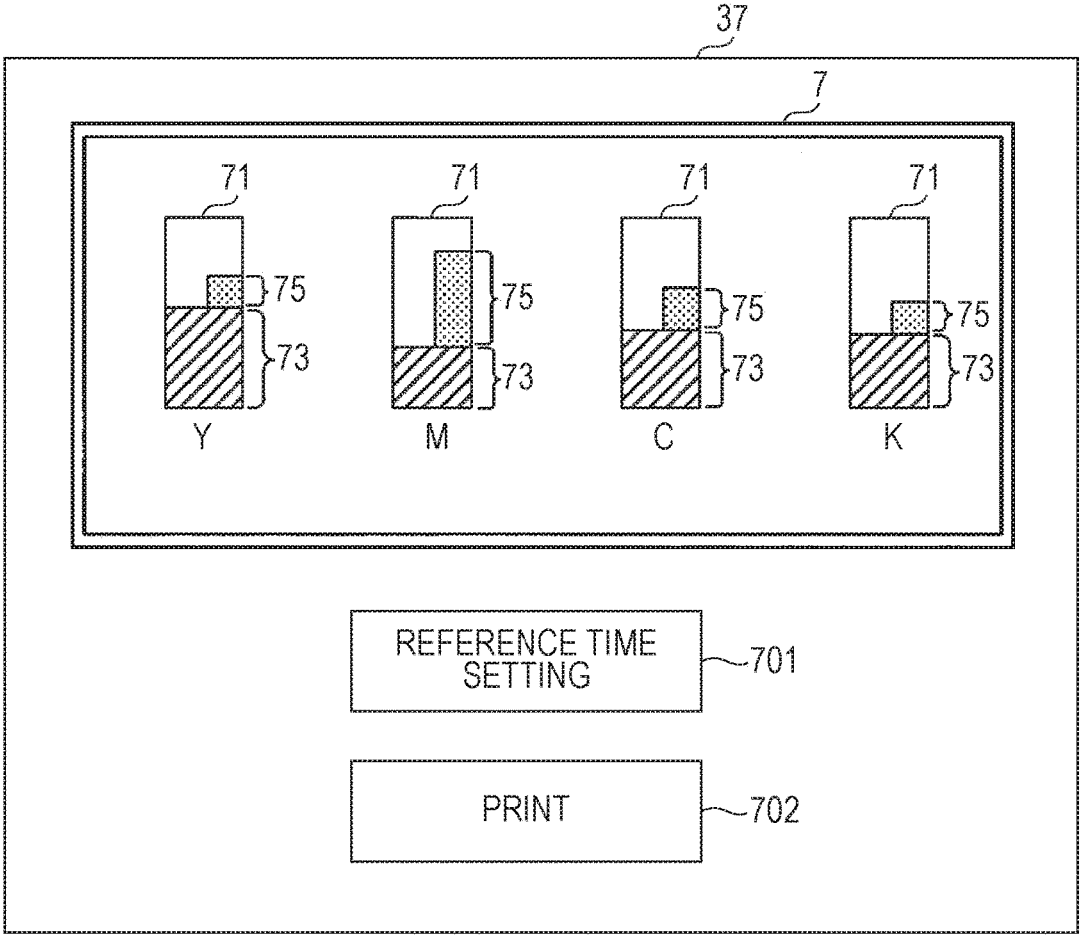
FIG. 2 is a diagram schematically illustrating an example of a screen which is a displayed on a display.

Furthermore, the engine section 3 has a display 37 (FIG. 2). Here, FIG. 2 is a diagram schematically illustrating an example of a screen which is a displayed on a display. A touch panel is provided on the display 37, information which indicates the state of the printer 1 is displayed toward the user, and the input operation from the user functions as a graphical user interface (GUI) in which the input operation is received from the user. As shown in FIG. 2, an ink status window 7, a reference time setting button 701, and a print button 702 are displayed on the display 37. Here, a button or the like may be selected and operated using an operation section which is provided separately and not the touch panel which is provided on the display 37, and the button operation is performed.

In the ink status window 7, indicators 71 which indicate a remaining amount of ink Dr and an amount of ink consumption Dc of the ink cartridge 311 are displayed in each color. In each indicator 71, a remaining amount display bar 73 which indicates the remaining amount of ink Dr of the ink cartridges 311 of the corresponding colors and a consumption amount display bar 75 which indicates the amount of ink consumption Dc from the reference time of the ink cartridges 311 of the corresponding colors are displayed together. The remaining amount display bar 73 has a length according to the remaining amount of ink Dr in the ink cartridges 311 of the corresponding colors, and expands and contracts in a vertical direction of the display 37 according to an increase and reduction of the remaining amount of ink Dr. In detail, an upper end of the remaining amount display bar 73 lowers when the remaining amount of ink Dr of the ink cartridge 311 reduces, and the upper end of the remaining amount display bar 73 increases when the remaining amount of ink Dr of the ink cartridge 311 increases. In addition, the consumption amount display bar 75 has a length according to the amount of ink consumption Dc in the ink cartridges 311 of the corresponding colors, and extends in a vertical direction of the display 37 according to an increase and reduction of the amount of ink consumption Dc from the reference time. In detail, a lower end of the consumption amount display bar 75 lowers when the amount of ink consumption Dc of the ink cartridge 311 increases. That is, the upper end of the consumption amount display bar 75 matches the upper end of the remaining amount display bar 73 at the reference time, and the lower end of the consumption amount display bar 75 matches the upper end of the remaining amount display bar 73 at the reference time. At this time, the remaining amount display bar 73 and the consumption amount display bar 75 change with the same proportion with respect to change of the amount of ink. That is, the amount that the length of the remaining amount display bar 73 changes when the remaining amount of ink Dr is changed in unit amount, and the amount that the length of the consumption amount display bar 75 changes when the amount of ink consumption Dc is changed in unit amount are the same.

In addition, the reference time setting button 701 and the print button 702 are buttons for the user to execute the input operation. In detail, the reference time setting button 701 is a button for setting the reference time that indicates a timing at which measurement of the amount of ink consumption is started, and the print button 702 is a button for executing the printing process.

The description will continue returning to FIG. 1. The controller 5 has a computation unit 51 and a storage unit 53. The computation unit 51 is a computer which is configured by a central processing unit (CPU) and a random access memory (RAM), and collectively controls the operation of the printer 1. The storage unit 53 is a hard disk drive (HDD) which stores various programs and data.

The respective remaining amounts of ink Dr and the amounts of ink consumption Dc of the ink cartridges 311 of each color are stored in the storage unit 53. Furthermore, a printing program Pp for executing printing in the printer 1 is stored in the storage unit 53. The printing program Pp is provided in a form which is recorded on a recording medium 10 that is writable by the computer, and is installed in advance in the storage unit 53. Then, when the computation unit 51 executes the printing program Pp, a printing control section 511, a remaining amount control section 513, a consumption amount control section 515, and an input and output control section 517 are constructed within the computation unit 51.

When the print button 702 which is displayed on the display 37 is touched by the user, the input and output control section 517 generates a print job, and outputs to the printing control section 511. Then, the printing process is executed by the printing control section 511 controlling the printing head 33 according to the print job. In addition, the computation unit 51 measures the remaining amount of ink Dr and the amount of ink consumption Dc in parallel to the printing process. As described above, the remaining amount of ink Dr is the remaining amount of ink in the ink cartridge 311, and the amount of ink consumption Dc is the amount of ink consumption from the reference time in the ink cartridge 311. The remaining amount of ink Dr and the amount of ink consumption Dc are individually obtained in each ink cartridge 311 and are stored in the storage unit 53.

Figure 3:
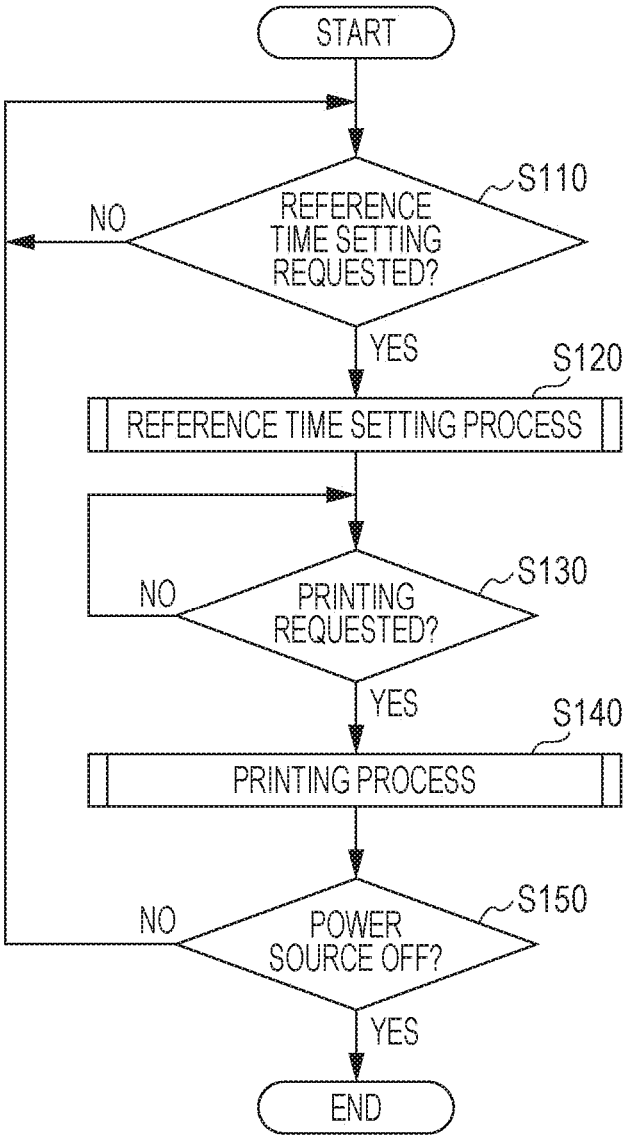
FIG. 3 is a flow chart illustrating an example of an operation which is executed by a computation unit.
Figure 4:
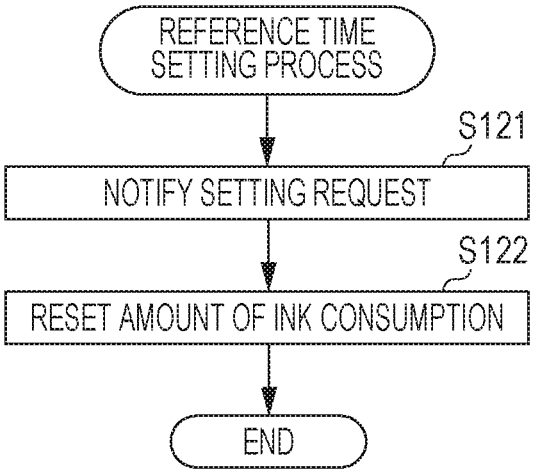
FIG. 4 is a flow chart illustrating an example of a reference time setting process.
Figure 5:
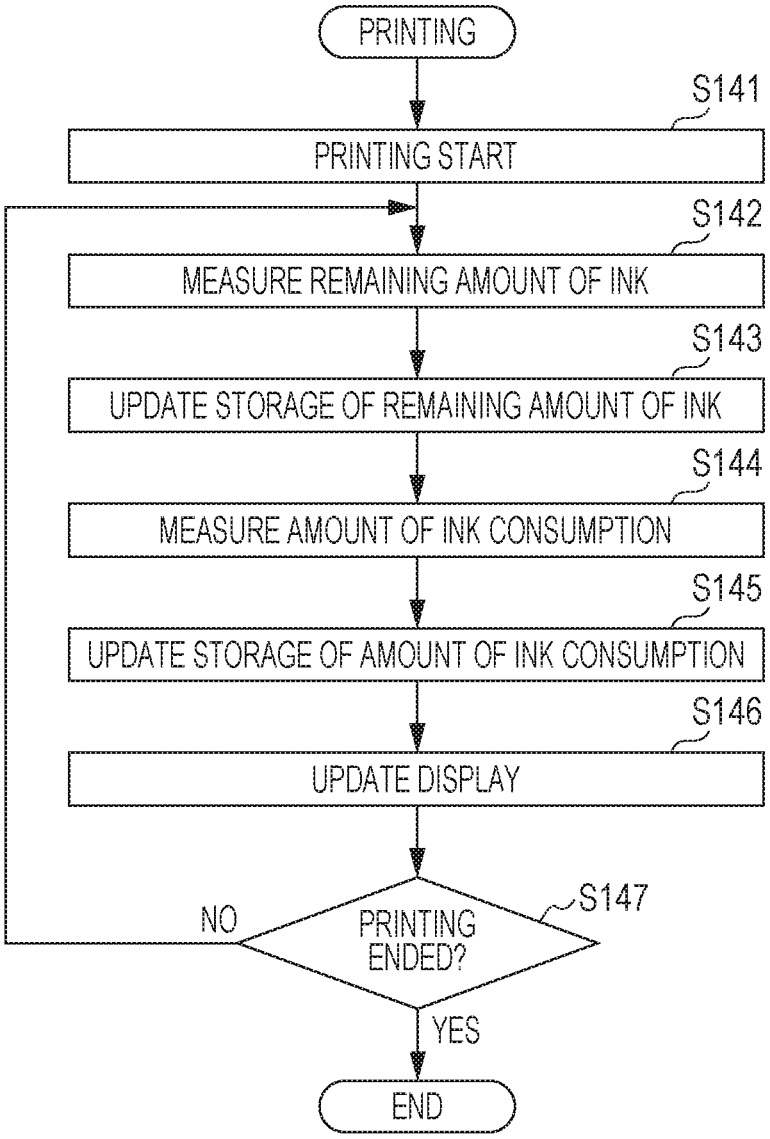
FIG. 5 is a flow chart illustrating an example of a printing process.
Figure 6:
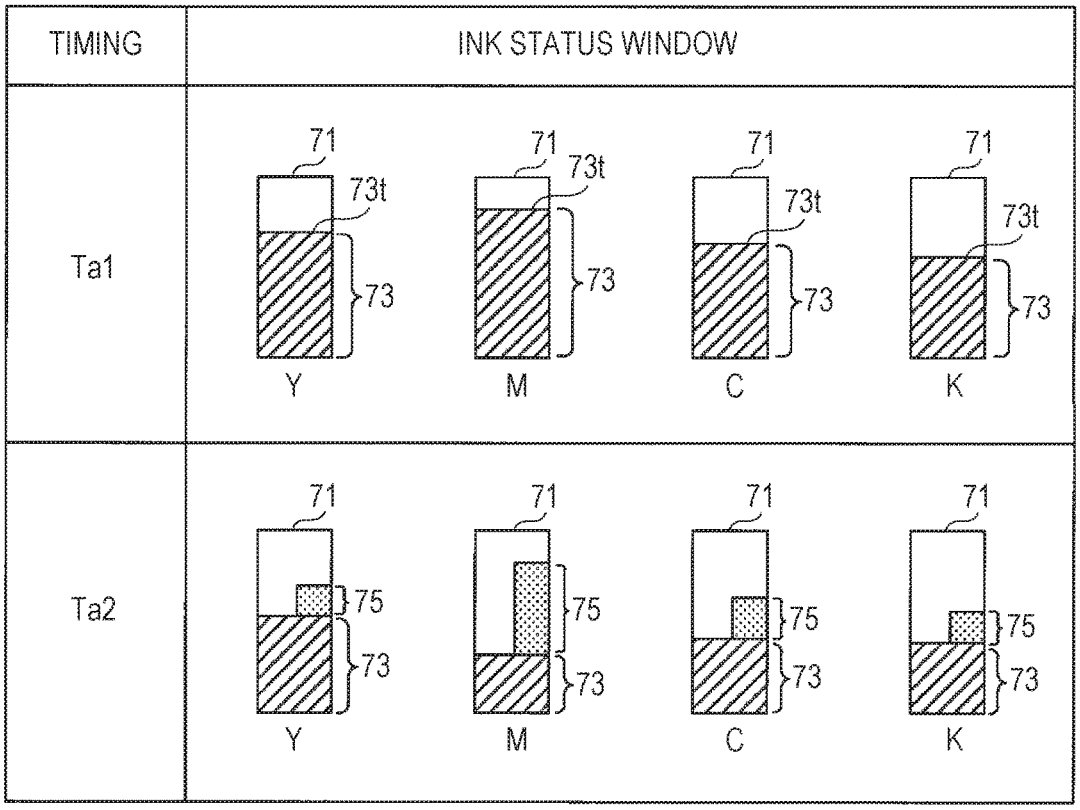
FIG. 6 is a diagram illustrating an example of display content of an ink status window.

Subsequently, details of the operation which is executed by the printer 1 are described in FIGS. 3 to 6. Here, FIG. 3 is a flow chart illustrating an example of an operation which is executed by a computation unit according to a program, FIG. 4 is a flow chart illustrating an example of a reference point setting process, FIG. 5 is a flow chart illustrating an example of the printing process, FIG. 6 is a diagram illustrating an example of display content of the ink status window, and in particular, the display content is indicated at each timing Ta1 to Ta2.

In step S110, the presence or absence of a setting request of the reference time corresponding to the timing at which the measurement (acquisition) of the amount of ink consumption starts is determined. That is, it is possible to perform the setting request of the reference time in the input and output control section 517 by executing the input operation in which the user touches the reference time setting button 701 which is displayed on the display 37. Therefore, in step S110, the presence or absence of the input of the setting request is confirmed by the input and output control section 517. Then, when the setting request of the reference time is present ("YES" in step S110), the computation unit 51 executes the reference time setting process (FIG. 4) of step S120.

In the reference time setting process, the presence of the setting request of the reference time is notified to the consumption amount control section 515 by the input and output control section 517 (step S121). When the notification is received, the consumption amount control section 515 resets the amount of ink consumption Dc of each ink cartridge 311 (step S122). In detail, the consumption amount control section 515 resets the amount of ink consumption Dc which is stored in the storage unit 53 to zero, and the upper end of the consumption amount display bar 75 is set to an upper end 73*t* of the remaining amount display bar 73 at that time (timing Ta1) in each ink cartridge 311. Here, since the amount of ink consumption Dc is reset to zero, the consumption amount display bar 75 is not represented in the ink status window 7 at the timing Ta1. Thereby, when the reference time setting process is complete, the process returns to the flow chart in FIG. 3.

In step S130, the presence or absence of the printing request from the user is confirmed by the input and output control section 517. In detail, the input and output control section 517 confirms the presence or absence of the printing request by determining whether or not the input operation is executed in which the user touches the print button 702 which is displayed on the display 37. Then, when there is a printing request, the computation unit 51 executes the printing process in step S140.

In the printing process (refer to FIG. 5), the printing control section 511 starts control of the printing head 33 based on the print job, and the discharge of ink which is supplied from each ink cartridge 311 by the printing head 33 is started (step S141). Thereby, when the discharge of ink is started from the printing head 33, the measurement of the remaining amount of ink Dr and the amount of ink consumption Dc are started by the computation unit 51 in each ink cartridge 311, and the storage of the storage unit 53 and the display of the display 37 are respectively updated according to the measurement (acquisition) result (steps S142 to S146). That is, the remaining amount control section 513 measures the remaining amount of ink Dr of each ink cartridge 311 (step S142), and the remaining amount of ink Dr which is stored in the storage unit 53 is rewritten in a measurement value in step S142 (step S143). In addition, the consumption amount control section 515 measures the amount of ink consumption Dc of each ink cartridge 311 (step S144), and the amount of ink consumption Dc which is stored in the storage unit 53 is rewritten in a measurement value in step S144 (step S145). Then, the input and output control section 517 updates the remaining amount display bar 73 and the consumption amount display bar 75 of the display 37 based on the remaining amount of ink Dr and the amount of ink consumption Dc which are stored in the storage unit 53 (step S146).

That is, various specific methods for measuring (acquiring) the remaining amount of ink Dr are considered. For example, it is possible to obtain the remaining amount of ink Dr based on a result in which the amount of ink that is used from a measurement time is calculated from the print job. Alternatively, it is possible to obtain the remaining amount of ink Dr based on the result in which a liquid surface of the ink within the ink cartridge 311 is detected by an optical sensor, a float sensor, or the like. For example, the amount of ink consumption Dc is able to be obtained from a difference between the remaining amount of ink Dr at the reference time (time of step S122) and the remaining amount of ink Dr of the measurement time. According to a more detailed description, in step S122 of the reference time setting process in FIG. 4, the amount of ink consumption Dc is reset, and the remaining amount of ink Dr at the reset time (that is, the timing Ta1) is stored as a reference remaining amount of ink Dr. Then, it is possible to obtain the amount of ink consumption Dc from the difference between the remaining amount of ink Dr at the measurement point in step S142 and the reference remaining amount of ink Dr. In addition, it is possible to acquire the amount at which the ink is actually discharged by counting the discharge count with respect to the discharge amount of one time.

In step S147, in a case where it is determined whether or not the printing ends and printing continues (in a case of "NO" in step S147), the process returns to step S142. That is, steps S142 to S146 are repeatedly operated until the printing ends. Accordingly, during the execution of printing, the remaining amount of ink Dr and the amount of ink consumption Dc are repeatedly measured (steps S143 and S144), and the display content of the ink status window 7 is updated at the time of measurement (step S146). Accordingly, for example, the remaining amount of ink Dr and the amount of ink consumption Dc at a latest measurement (acquisition) time are respectively displayed by the remaining amount display bar 73 and the consumption amount display bar 75 on the ink status window 7 at the timing Ta2 (FIG. 6) at which printing ends.

When printing ends ("YES" in step S147), and the process returns to the flow chart in FIG. 3. In step S150, the computation unit 51 determines whether or not the power source of the printer 1 is requested to turn off. Then, in a case where there is no request to turn the power source off (in a case of "NO" in step S150), the process returns to step S110. That is, until there is a request to turn off the power source, steps S110 to S140 are repeatedly executed. Meanwhile, in a case where there is a request to turn the power source off (in a case of "YES" in step S150), the flow chart in FIG. 3 ends.

In the embodiment as described above, the amount of ink consumption Dc due to printing is measured executed according to the print job, and the remaining amount of ink Dr in the ink cartridge 311 is measured. Then, the amount of ink consumption Dc and the remaining amount of ink Dr is displayed on the display 37. Accordingly, the user estimates the amount of ink that is necessary for printing which is scheduled to be executed by confirming the amount of ink consumption Dc in printing that was executed in the past on the display 37, and is able to simply determine whether or not it is necessary to replace the cartridge 311 by comparing the estimation result to the remaining amount of ink Dr of the display 37.

In detail, in an example which is indicated in FIG. 6, the user starts the printing of a predetermined amount (steps S130 and S140) since the setting of the reference time is performed at the timing Ta1 (steps S110 and S120). Then, at the time at which the printing of the predetermined amount ends, the content which corresponds to the timing Ta2 in FIG. 6 is displayed on the ink status window 7. At the timing Ta2, the amount of ink consumption Dc which is indicated by the consumption amount display bar 75 of the ink status window 7 corresponds to the amount of ink which is consumed by printing of the predetermined amount. In this manner, it is possible for the user to know the amount of ink which is consumed during actual printing by confirming the consumption amount display bar 75. Moreover, the remaining amount of ink Dc and the amount of ink consumption Dr are indicated on the ink status window 7. For this reason, the user is able to simply determine whether or not it is necessary to replace the cartridge 311 by comparing the amount of ink consumption Dc and the remaining amount of ink Dr. For example, in a case where the printing of the same predetermined amount is executed again, since the remaining amount display bar 73 is longer than the consumption amount display bar 75 for yellow (Y), cyan (C), and black (K), there is no possibility of ink running out midway through reprinting, and it is possible to determine that it is unnecessary to replace the ink cartridge 311. Meanwhile, since the remaining amount display bar 73 is shorter than the consumption amount display bar 75 for M (magenta), there is a possibility of ink running out midway through reprinting, and it is possible to determine that it is good to replace the ink cartridge 311.

In particular, in the embodiment, the amount of ink which is consumed by printing executed at a reference point in time or after is measured (acquired) as the amount of ink consumption Dc. Moreover, the display 37 is provided which is provided with a touch panel on which the user is able to execute the input operation, and the reference time is set according to the content of the input operation on the touch panel of the display 37. Accordingly, it is possible to arbitrary set the reference time by the user operating the touch panel on the display 37. For this reason, the user sets the reference time before executing printing for which it is desired to know the amount of ink consumption Dc, and it is possible to know the amount of ink consumption Dc accompanying printing if the consumption amount display bar 75 is confirmed after printing ends. Thereby, it is possible to more precisely correspond to the user's needs.

In this manner, in the embodiment, the printer 1 is equivalent to an example of the "printer" as the remaining amount of ink display apparatus of the invention, the engine section 3 is equivalent to an example of the "printing executing section" in the invention, the ink cartridge 311 is equivalent to an example of the "cartridge" in the invention, the consumption amount control section 515 is equivalent to an example of the "consumption amount acquiring section" in the invention, the amount of ink consumption Dc is equivalent to an example of the "amount of ink consumption" in the invention, the remaining amount control section 513 is equivalent to an example of the "remaining amount acquiring section" in the invention, the remaining amount of ink Dr is equivalent to an example of the "remaining amount of ink" in the invention, the display 37 is equivalent to an example of the "display section" or the "input operation section" in the invention, the input and output control section 517 is equivalent to an example of the "display control section" in the invention, the time at which the amount of ink consumption Dc of the storage unit 53 is reset is equivalent to an example of the "reference time" in the invention, and the ink status window 7 is equivalent to an example of the "window" in the invention.

Here, the present invention is not limited to the embodiments described above and it is possible to add various modifications with regard to the above description without deviating from the gist of the present invention. Accordingly, for example, various modifications are possible concerning the display form of the amount of ink consumption Dc in the ink status window 7. Subsequently, modification examples will be described. Here, although description will be described below focusing on differences between each modification example and the embodiments, needless to say the same effects are exhibited by providing a configuration in which each modification example is common to the embodiments.

Figure 7:
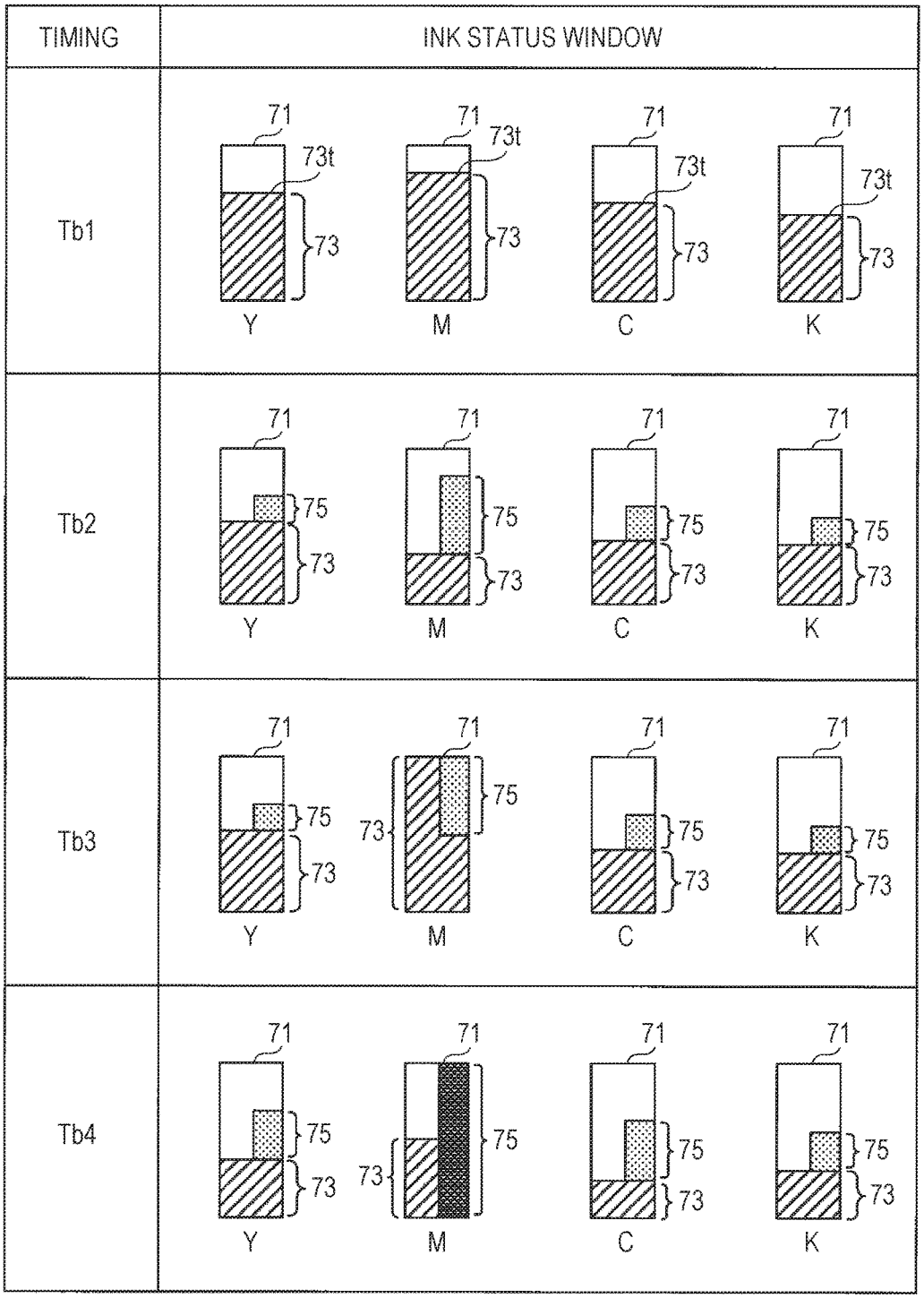
FIG. 7 is a diagram illustrating the display content of the ink status window according to a first modification example.

FIG. 7 is a diagram illustrating the display content of the ink status window according to a first modification example, and in particular, illustrates the display content at each timing Tb1 to Tb4. In detail, the "Timing Tb1" column in FIG. 7 indicates the display content of the ink status window 7 at the time (reference time) at which the amount of ink consumption Dc is reset in step S112, the "Timing Tb2" to the "Timing Tb4" columns in FIG. 7 indicate the display content of the ink status window 7 at each of the timings Tb2 to Tb4 which change accompanying printing after the reference time is set.

In particular, FIG. 7 illustrates a case in which printing is suspended at the timing Tb2, and subsequently the M (magenta) ink cartridge 311 is replaced at the timing Tb3. As shown in the "Timing Tb3" column in FIG. 7, the remaining amount display bar 73 for M (magenta) is lengthened to the maximum displayable length in the indicator 71 accompanying replacement of the ink cartridge 311. At this time, the user who desires to know the amount of ink consumption Dc which is necessary in a case in which the suspension of printing is accomplished does not reset the reference time even if the ink cartridge 311 is replaced. For this reason, the length of the consumption amount display bar 75 does not change. However, the ink which is consumed at a fast a pace as is necessary for replacement during printing is considered to be consumed at a fast pace in the same manner even after the cartridge replacement. For this reason, it is preferable that the extendable range of the consumption amount display bar 75 is secured in the indicator 71. Therefore, as shown in the "Timing Tb3" column in FIG. 7, the input and output control section 517 matches the upper end of the consumption amount display bar 75 and the upper end of the remaining amount display bar 73 by shifting the consumption amount display bar 75 upward accompanying replacement of the ink cartridge 311. Thereby, the extendable range of the consumption amount display bar 75 in the indicator 71 is secured therebelow.

When the consumption of ink of the ink cartridge 311 proceeds by restarting printing after replacement of the ink cartridge 311, as shown in the "Timing Tb4" column in FIG. 7, there are cases where the consumption amount display bar 75 is extended as much as the lower end of the consumption amount display bar 75 reaches to the lower end of the indicator 71. In this case, the input and output control section 517 displays a warning which indicates the corresponding consumption amount display bar 75 is not able to extend any further to the user. The example in FIG. 7, executes the warning display by changing the hatching of the corresponding consumption amount display bar 75. However, the form of the warning display may be performed by modifying, lighting up, or the like the color of the consumption amount display bar 75.

Figure 8:
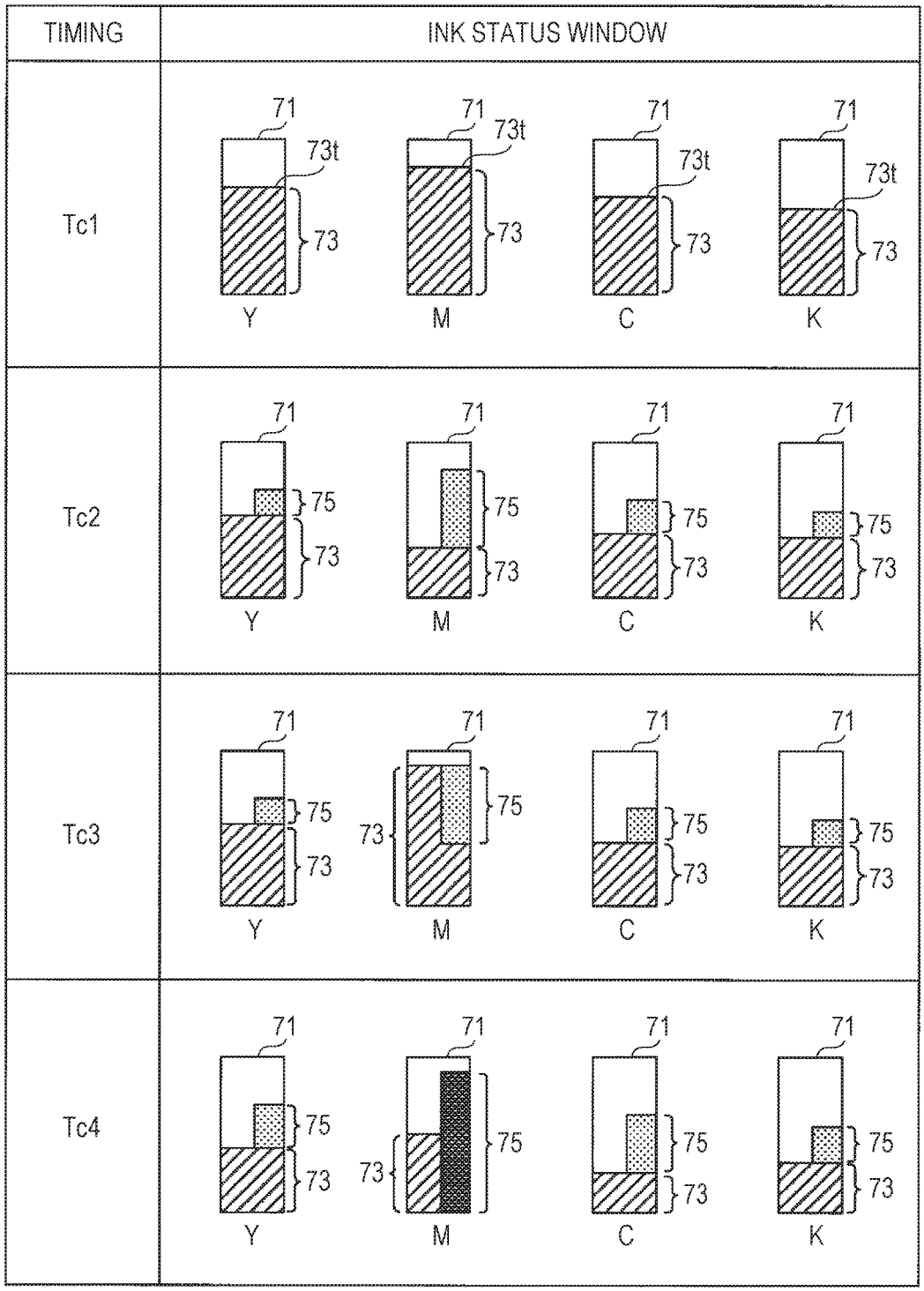
FIG. 8 is a diagram illustrating the display content of the ink status window according to a second modification example.

FIG. 8 is a diagram illustrating the display content of the ink status window according to a second modification example, and in particular, illustrates the display content at each timing Tc1 to Tc4. In detail, the "Timing Tc1" column in FIG. 8 indicates the display content of the ink status window 7 at the time (reference time) at which the amount of ink consumption Dc is reset in step S112, the "Timing Tc2" to the "Timing Tc4" columns in FIG. 8 indicate the display content of the ink status window 7 at each of the timings Tc2 to Tc4 which change accompanying printing after the reference time is set.

In the same manner as in the first modification example, also in the second modification example, printing is suspended at the timing Tc2, and subsequently the M (magenta) ink cartridge 311 is replaced at the timing Tc3. However, with respect to a first applied example in which replacement is made with the ink cartridge 311 in which ink is added to be full, in a second applied example replacement is made with the ink cartridge 311 in which ink is slightly depleted (the "timing Tc3" column). Even in the second applied example, the input and output control section 517 shifts the consumption amount display bar 75 up such that the upper end of the consumption amount display bar 75 matches the upper end of the remaining amount display bar 73 accompanying replacement of the ink cartridge 311 (the "timing Tc3" column). In addition, when the lower end of the consumption amount display bar 75 reaches the lower end of the indicator 71, the input and output control section 517 displays the warning to the user (the "timing Td3" column).

Figure 9:
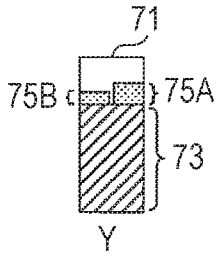
FIG. 9 is a diagram illustrating the display content of the ink status window according to a third modification example.
Figure 9:
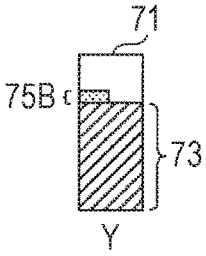
Figure 9:
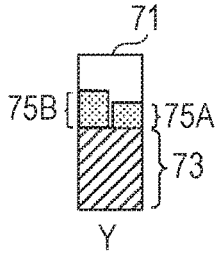
Figure 9:
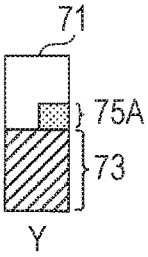
Figure 9:
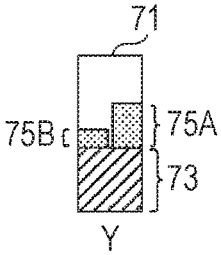
Figure 10A:
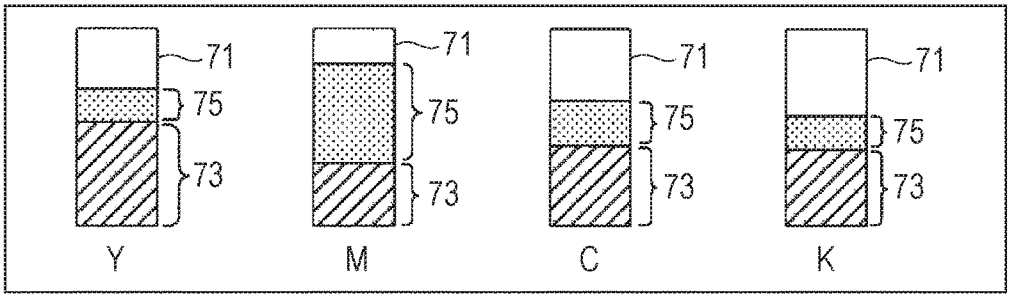
FIG. 10A is a diagram further illustrating various modification examples of ink status windows.
Figure 10B:
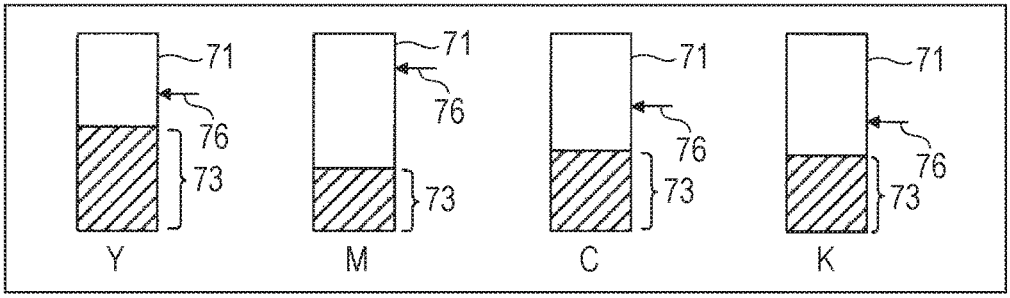
FIG. 10B is a diagram further illustrating various modification examples of ink status windows.
Figure 10C:
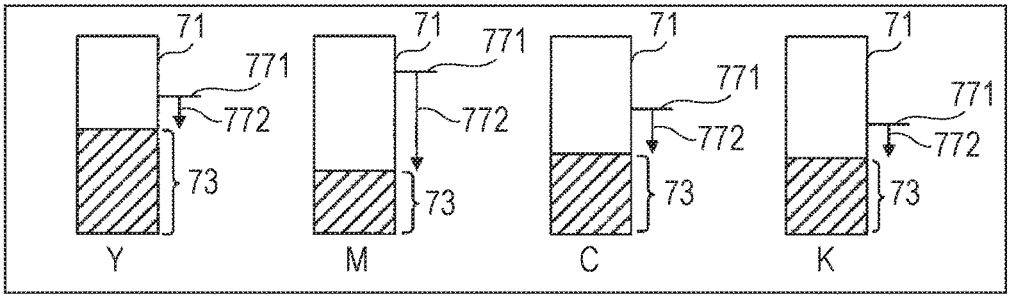
FIG. 10C is a diagram further illustrating various modification examples of ink status windows.
Figure 10D:
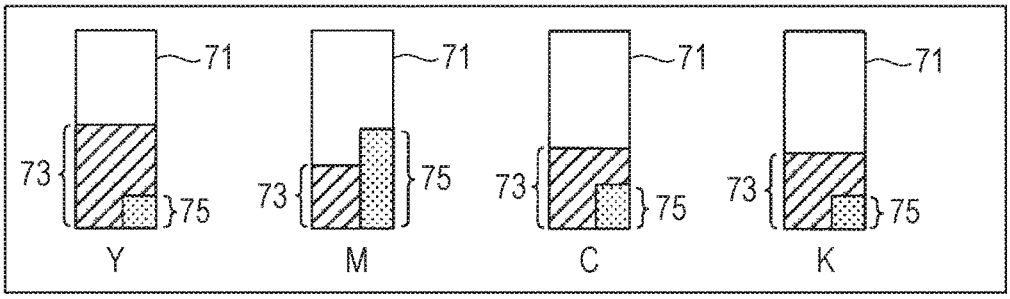
FIG. 10D is a diagram further illustrating various modification examples of ink status windows.

FIG. 9 is a diagram illustrating the display content of the ink status window according to a third modification example, and in particular, illustrates the display content at each timing Td1 to Td5. Here, since the configurations of the indicator 71 of each color are the same, here the configuration of the Y (yellow) indicator 71 is described, and description of the other colors is omitted. In the third modification example, it is possible to set two reference times for each ink cartridge 311, and respectively measure the amount of ink consumption Dc from each reference time. Corresponding thereto, in the indicator 71, two consumption amount display bars 75A and 75B which indicate the amount of ink consumption Dc of the reference times which are respectively different are displayed for each ink cartridge 311.

In the example shown in FIG. 9, at the timing Td1, the two consumption amount display bars 75A and 75B are displayed which are the results of measurement from the reference times at which the amounts of ink consumption Dc of the Y (yellow) ink cartridge 311 are different. When the user sets the reference time corresponding to the consumption amount display bar 75A, the timing Td2 of the time is newly set as the reference time. As a result, after the timing Td2, the result in which the amount of ink consumption Dc from the timing Td2 is measured is indicated as the consumption amount display bar 75A. In addition, when the user sets the reference time corresponding to the consumption amount display bar 75B, the timing Td4 of the time is newly set as the reference time. As a result, after the timing Td4, the result in which the amount of ink consumption Dc from the timing Td4 is measured is indicated as the consumption amount display bar 75B.

That is, in a third applied example, the consumption amount control section 515 is able to select each a plurality of reference times which correspond to timings that are different from each other for each ink cartridge 311, and the amount of ink consumption Dc of each of the plurality of reference times is measured for each ink cartridge 311. Corresponding thereto, the input and output control section 517 displays the amount of ink consumption Dc of each of the plurality of reference times for each ink cartridge 311. Thereby, it is possible for the user to ascertain the amount of ink consumption Dc from the plurality of different reference points, and information which is able to be utilized by the user is enriched by estimating an amount of ink that is necessary in printing which is subsequently executed. As a result, the user is able to more precisely ascertain the amount of ink that is necessary in printing which is subsequently executed.

For example, a case is considered in which 100 units of an image A are continuously printed, and 100 units of an image B which is different from the image A are printed. In this case, it is possible for the user to perform an operation of setting the reference time of the consumption amount display bar 75A directly before starting printing of the image A, and setting the reference time of the consumption amount display bar 75B until printing of the image A ends and printing of the image B is started. Thereby, when the printing of the images A and B is complete, the consumption amount display bar 75A indicates the amount of ink consumption Dc which is necessary to print both images A and B, and the consumption amount display bar 75B indicates the amount of ink consumption Dc which is necessary to print the image B. Accordingly, in a case where printing of both images A and B is subsequently performed, the user is able to estimate the amount of ink which is necessary from the consumption amount display bar 75A, and in a case where the printing of the image B is performed, is able to estimate the amount of ink which is necessary from the consumption amount display bar 75B. Alternatively, in a case where printing of the image A is subsequently performed, the user is able to estimate the amount of ink which is necessary from the difference between the consumption amount display bars 75A and 75B. Thereby, the user is able to more precisely ascertain the amount of ink that is necessary in printing which is subsequently executed.

FIGS. 10A to 10D are diagrams further illustrating various modification examples of ink status windows. In each indicator 71 in FIG. 10A, the consumption amount display bar 75 has the same width as the remaining amount display bar 73 in a lateral direction of the display 37. In each indicator 71 in FIG. 10B, an arrow 76 which indicates a position of the upper end of the remaining amount display bar 73 at the reference time is displayed. In the modification example, a distance between the arrow 76 and the upper end of the remaining amount display bar 73 indicates the amount of ink consumption Dc. In each indicator 71 in FIG. 10C, a lateral line 771 which indicates the position of the upper end of the remaining amount display bar 73 at the reference time, and an arrow 772 which indicates the distance from the lateral line 771 to the upper end of the remaining amount display bar 73 are displayed. In the modification example, the length of the arrow 772 indicates the amount of ink consumption Dc. In addition, in each indicator 71 in FIG. 10D, the consumption amount display bar 75 is displayed such the lower end of the consumption amount display bar 75 and the lower end of the remaining amount display bar 73 match.

In addition, in the embodiment, the common reference times are set with respect to the plurality of ink cartridges 311 (step S122), and the amounts of ink consumption Dc of the plurality of ink cartridges 311 measure the common reference times at the origin. However, the consumption amount control section 515 may be configured such that out of the ink cartridges 311 of four colors, for example, the reference times of the K (black) ink cartridge 311 and the reference times of the other color (Y, M, and C) ink cartridges 311 are set to be independent from each other. In this case, the consumption amount control section 515 measures the amount of ink consumption Dc from the reference times which correspond to each ink cartridge 311. That is, the amount of ink consumption Dc of each color ink cartridge 311 is measured from the reference times which are set with respect to the color ink cartridges 311. Meanwhile, the amount of ink consumption Dc of the K (black) ink cartridge 311 is measured from the reference times which are set with respect to the K (black) ink cartridge 311 independently from the color. With this configuration it is possible to set the reference points independently from each other in at least two ink cartridges 311, and it is possible to more widely correspond to the user's needs. Here, the case in which the K (black) reference times are set independently from the color reference times is exemplified, but there may be a configuration such that in a case where white, metallic, or like are used, the reference times are set so as to be independent from the color reference times.

At this time, there also may be a configuration in which the reference times of each of the color ink cartridges 311 are set so as to be independent from each other. Alternatively, there may be a configuration in which the reference times of each of the color ink cartridges 311 are set so as to be common reference times. In this case, the consumption amount control section 515 sets common reference times for three color ink cartridges 311 (specific cartridges) out of the four ink cartridges 311. Meanwhile, the consumption amount control section 515 sets the reference times for the K (black) ink cartridge 311 to be independent from the color ink cartridges 311. With this configuration, it is possible to set common reference points in the plurality of color ink cartridges 311, it is possible to set the reference points independently from the other ink cartridges 311, and it is possible to more widely correspond to the user's needs. Here, the case in which the common reference times of the three ink cartridges 311 are set is exemplified, but the number of the ink cartridges 311 to which the common reference times are set may be two or four or more.

In addition, in the embodiment, the consumption amount control section 515 sets the reference times according to the input operation of the user. However, regardless of the input operation of the user, it is also possible to configure such that the consumption amount control section 515 individually sets the reference times. In detail, the consumption amount control section 515 may be configured such that the content of the print job is analyzed, and the reference times are set according to analysis result. With this configuration, the reference points that are given a timing at which measurement of the amount of ink consumption Dc is started are set according to the content of the print job, and the amount of ink consumption Dc which is necessary for printing the content is displayed on the display 37. Accordingly, it is possible for the user to estimate the amount of ink that is necessary in printing which is subsequently executed while considering the content of the printing for which the amount of ink consumption Dc is necessary that is displayed on the display 37, and it is possible to more precisely ascertain the amount of ink.

In detail, in a case where the number of sheets to be printed that is indicated in the print job is a predetermined number or more, the consumption amount control section 515 may set the reference points according to the timing at which printing is started based on the print job. With this configuration, the user is able to confirm the amount of ink that is necessary in printing the number of sheets of the predetermined number or more using the display 37. In addition, in a case where ink of a specific color (for example, white) is used in printing that is indicated in the print job, the consumption amount control section 515 may set the reference points according to the timing at which printing is started based on the print job. Alternatively, in a case where the content is indicated in the print job when printing of the images A and B which are exemplified above are printed by each section 100, the consumption amount control section 515 may set the reference times at a timing at which the printing of the image A is started, or at a timing at which the printing of the image B is started. Furthermore, conditions or the like of the print job which trigger the setting of the reference times (the number of sheets to be printed, the color of ink which is used in printing, and the image content) may be configured such that the user is able to set the consumption amount control section 515 via the touch panel on the display 37.

In addition, in the embodiment, the input and output control section 517 displays the remaining amount of ink Dr and the amount of ink consumption Dc together on the same ink status window 7 as the remaining amount display bar 73 and the consumption amount display bar 75. However, the input and output control section 517 may separately display the remaining amount of ink Dr and the amount of ink consumption Dc on different windows. In detail, a window which indicates the remaining amount display bar 73 that indicates the remaining amount of ink Dr, and a window which indicates the amount of ink consumption Dc may be separately displayed on the display 37.

In addition, in the printer 1 which is provided with the maintenance unit 35 as described above, maintenance is carried out during printing. Then, in the maintenance, ink is consumed in order to appropriately execute suction of ink from the printing head 33. Therefore, when the remaining amount of ink Dr and the amount of ink consumption Dc are measured, consumption of ink may be considered accompanying maintenance. That is, in a case where ink is consumed due to maintenance, the remaining amount of ink Dr may be reduced by the consumed portion, and the amount of ink consumption Dc increases. That is, in a case where a liquid surface of ink is detected by a sensor, ink consumption accompanying maintenance may be obtained from a detection value of the sensor. Meanwhile, in a configuration in which the amount of ink which is used in printing is calculated from the print job, the amount of ink consumption accompanying maintenance is not limited to being able to be directly obtained. In this case, for example, a result may be used which directly obtains ink consumption, in advance, accompanying maintenance. In addition, when the remaining amount of ink is measured, the amount which is evaporated according to an elapsed time may be considered. The amount which is evaporated over an elapsed time may be calculated by adding a value that is calculated from a value in which the amount of ink consumption is calculated from the print job or a value in which the actual amount of ink which is discharged is counted, and the amount of ink consumption accompanying maintenance.

In addition, an attachable and detachable ink cartridge as an ink retaining section is described as an example, but is not limited thereto. There may be a configuration in which ink is refillable with respect to a tank which is able to retain ink. Here, even if fixed, the tank may be attachable and detachable.

In addition, in the embodiment, the remaining amount display bar 73 and the consumption amount display bar 75 are disposed toward the vertical direction of the display 37. However, the remaining amount display bar 73 and the consumption amount display bar 75 may also be disposed toward the lateral direction of the display 37.

Second Embodiment

Figure 11:
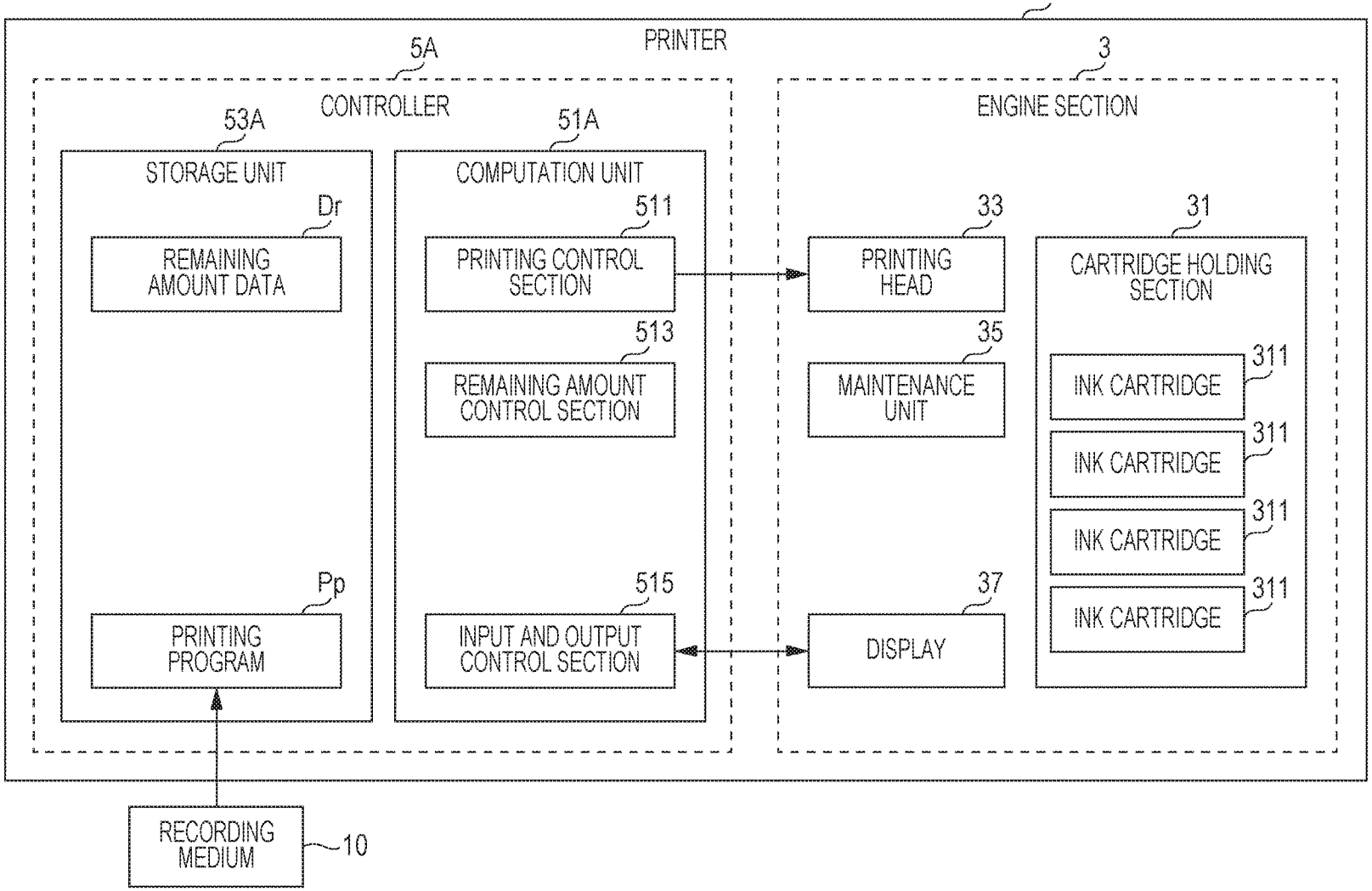
FIG. 11 is a block diagram illustrating a configuration according to a second embodiment of a printer as an example of a remaining amount of ink display apparatus to which the invention can be applied.

FIG. 11 is a block diagram illustrating a configuration according to a second embodiment of a printer as an example of a remaining amount of ink display apparatus to which the invention can be applied. Here, in FIG. 11, the recording medium 10 which is, for example, a digital versatile disc (DVD), a universal serial bus (USB) memory, and the like is shown other than in a printer 1A. In addition, in the description below, description of configuration elements which are the same as in the first embodiment described above is omitted and the same reference numerals are given.

As shown in FIG. 11, the printer 1A has an engine section 3 which is a mechanical configuration of the printer 1A and a controller 5A which is an electrical configuration which controls the engine section 3. The engine section 3 of the printer 1A discharges ink in a web using an ink jet system, and is provided with the same configuration as the mechanical configuration of the printer which is indicated in, for example, JP-A-2014-180805, JP-A-2013-997, or the like. Here, since the engine section 3 is configured in the same manner as in the first embodiment described above, description is omitted.

Furthermore, the engine section 3 has the display 37. A touch panel is provided on the display 37, information which indicates the state of the printer 1A is displayed toward the user, and the input operation from the user functions as a graphical user interface (GUI) in which the input operation is received from the user. In particular, in the embodiment, as described later, the display 37 displays information which relates to ink that is retained in each ink cartridge 311 according to a request from the user.

The controller 5A has a computation unit 51A and a storage unit 53A. The computation unit 51A is a computer which is configured by a central processing unit (CPU) and a random access memory (RAM), and collectively controls the operation of the printer 1A. The storage unit 53A is a hard disk drive (HDD) which stores various programs and data.

The remaining amount of ink Dr which relates to the remaining amount of ink in the respective ink cartridges 311 of each color is stored in the storage unit 53A. Furthermore, a printing program Pp for executing printing in the printer 1A is stored in the storage unit 53A. The printing program Pp is provided in a form which is recorded in the recording medium 10 that is writable by the computer, and is installed in advance in the storage unit 53A. Then, when the computation unit 51A executes the printing program Pp, the printing control section 511, the remaining amount control section 513, and the input and output control section 517 are constructed within the computation unit 51A.

When the user inputs an operation to request printing execution by touching the touch panel on the display 37, the input and output control section 517 generates a print job, and outputs to the printing control section 511. Then, the printing process is executed by the printing control section 511 controlling the printing head 33 according to the print job. Such a printing process is executed whenever the operation is input in which printing execution is requested with respect to the touch panel on the display 37. In addition, since the remaining amount control section 513 confirms the amount of ink within each ink cartridge 311 that reduces accompanying execution of the printing process, the flow chart in FIG. 12 is executed.

Figure 12:
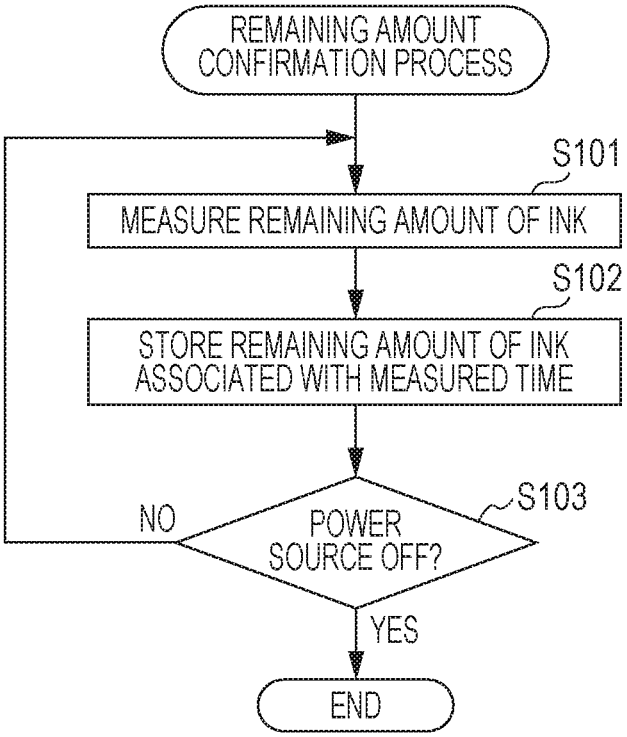
FIG. 12 is a flow chart illustrating an example of a process which confirms the remaining amount of ink.

FIG. 12 is a flow chart illustrating an example of a process which confirms the remaining amount of ink. In a remaining amount confirmation process, the remaining amount control section 513 measures the remaining amount of ink in each ink cartridge 311 (step S101). That is, various specific methods for measuring the remaining amount of ink are considered. For example, it is possible to obtain the remaining amount of ink based on a result in which the amount of ink that is used is calculated from the print job from a measurement time. Alternatively, it is possible to obtain the remaining amount of ink based on the result in which a liquid surface of the ink within the ink cartridge 311 is detected by an optical sensor, a float sensor, or the like. In addition, it is possible to acquire the amount at which the ink is actually discharged by counting the discharge count with respect to the discharge amount of one time.

In step S102, the measurement result of step S101 is associated with a measurement time (that is, a time at which measurement is executed), and stored in the storage unit 53A as the remaining amount data Dr. Then, the remaining amount control section 513 repeatedly performs steps S101 and S102 until the power source of the printer 1A is off (until "YES" is determined in step S103). In this manner, the remaining amount of ink Dr is data which indicates a measurement result of the remaining amount of ink of each of a plurality of measurement times, and is stored in the storage unit 53A in a format of a table that associates the measurement times with the measurement results of the remaining amount of ink at the measurement times. The remaining amount of ink Dr is stored in the storage unit 53A by obtaining for each ink cartridge 311.

Figure 13:
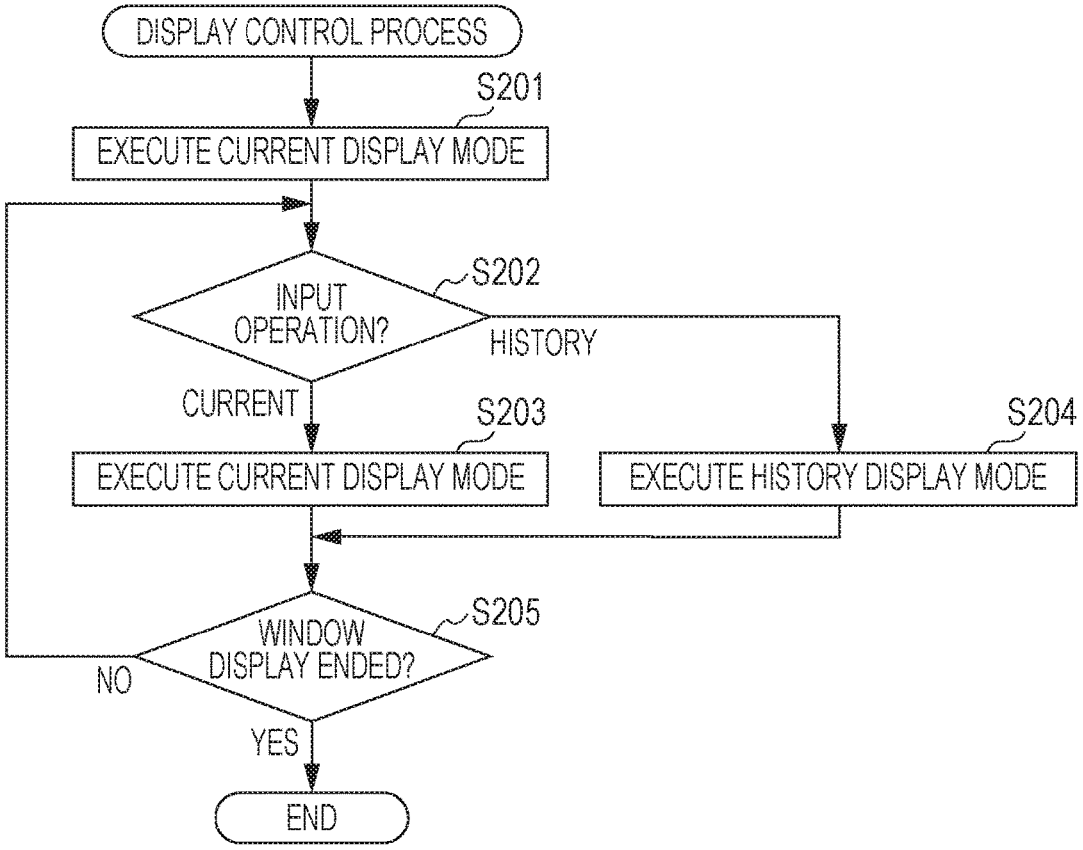
FIG. 13 is a flow chart illustrating an example in which a remaining amount data of ink is displayed on a display.
Figure 14:
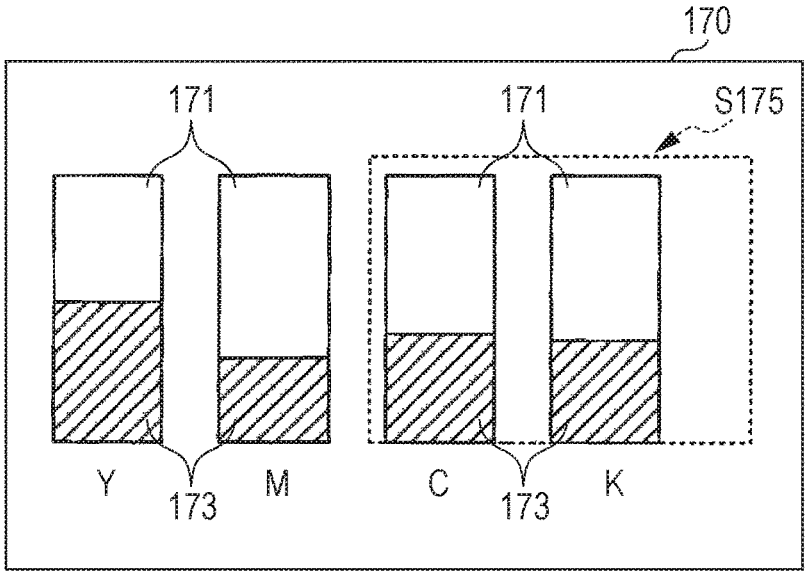
FIG. 14 is a diagram illustrating an example of displaying on a display in a current display mode.
Figure 15:
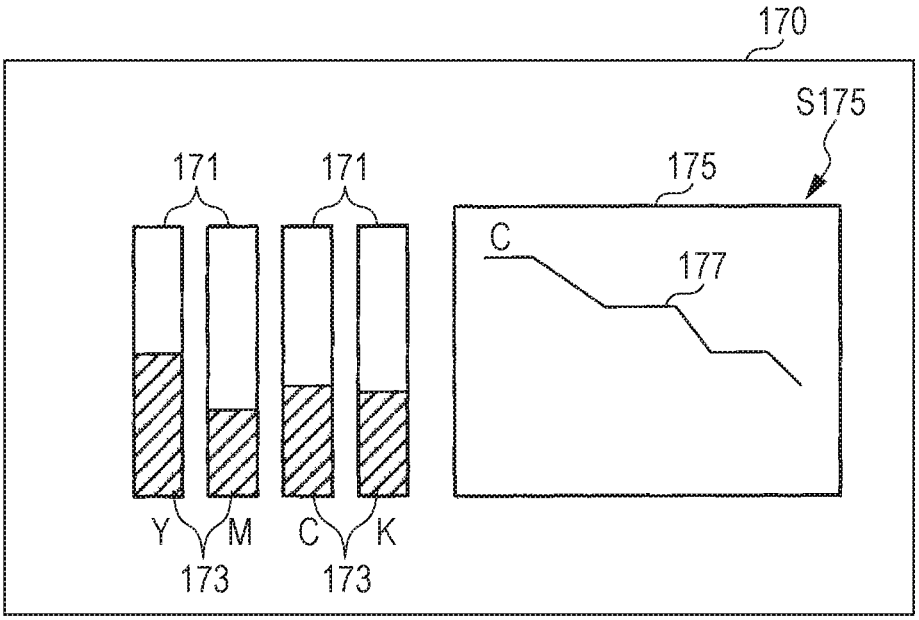
FIG. 15 is a diagram illustrating an example of displaying on a display in a history display mode.

Then, in the embodiment, the user is able to appropriately confirm the content of the remaining amount data Dr. That is, when the user inputs the operation in which display of the remaining amount data Dr is requested with respect to the touch panel on the display 37, the input and output control section 517 displays the remaining amount data Dr on the display 37 in a form which is requested by the user by executing the flow chart in FIG. 13. Here, FIG. 13 is a flow chart illustrating an example of a process in which information that indicates the remaining amount data of ink is displayed on a display. In addition, FIG. 14 is a diagram illustrating an example of a window which is displayed on the display in a current display mode that is executed using the flow chart in FIG. 13. FIG. 15 is a diagram illustrating an example of a window which is displayed on the display in a history display mode that is executed using the flow chart in FIG. 13. That is, in FIG. 14, a dashed line rectangle which is given the reference numeral 175 is displayed for the reason described later, and is not actually displayed on the display.

When the display control process is started in FIG. 13, the input and output control section 517 executes a current display mode in which the remaining amount of ink of each ink cartridge 311 at the current time is displayed on the display 37 (step S201). In the current display mode, an ink status window 170 which is shown in FIG. 14 is displayed on the display 37. That is, on the ink status window 170 of the current display mode, the ink cartridges 311 of each color are respectively displayed by a current remaining amount indicator 171. Each current remaining amount indicator 171 indicates the remaining amount of ink at the current time of the ink cartridge 311 of the corresponding color using a current remaining amount display bar 173. The current remaining amount display bar 173 has a length according to the remaining amount of ink in the ink cartridge 311 of the corresponding color at the current time, and expands and contracts in the vertical direction of the display 37 according to an increase and reduction of the remaining amount of ink. In detail, an upper end of the current remaining amount display bar 173 lowers when the remaining amount of ink of the ink cartridge 311 reduces, and the upper end of the current remaining amount display bar 173 increases when the remaining amount of ink of the ink cartridge 311 increases. That is, the input and output control section 517 displays the remaining amount of ink at the latest measurement time that is indicated by the remaining amount data Dr for the ink cartridges 311 of each color as the remaining amount of ink of the current time.

With this configuration, the user is able to ascertain the remaining amount of ink at the current time in each of the ink cartridges 311 of the four colors by confirming each current remaining amount indicator 171 which is indicated on the display 37 by executing the current display mode. Furthermore, the user is able to confirm the history of the remaining amount of ink of the selection target by executing the selection operation in which one of the current remaining amount indicators 171 of each of the four colors is selected on the display 37.

That is, the input and output control section 517 monitors the input operation by the user on the touch panel on the display 37 (step S202). In detail, the input and output control section 517 determines whether or not the selection operation is input in which any one of the four current remaining amount indicators 171 which are displayed on the display 37 is touched (tapped). Then, in a case where the input of the selection operation is not confirmed, the input and output control section 517 proceeds to step S203 to execute the current display mode, and the ink status window 170 in FIG. 14 is displayed on the display 37.

In a case where it is possible to confirm input of the selection operation, the input and output control section 517 proceeds to step S204 to execute the history display mode. In the history display mode, the ink status window 170 which is shown in FIG. 15 is displayed on the display 37. In the same manner as in the current display mode described above, the current remaining amount indicators 171 of each of the four colors are displayed on the ink status window 170 also in the history display mode. Furthermore, on the ink status window 170 of the history display mode, a history display space S175 is formed on the right side of the current remaining amount indicators 171 of each of the four colors, and a remaining amount history indicator 175 is displayed in the history display space S175.

The remaining amount history indicator 175 displays a change over time of the remaining amount of ink of the ink cartridges 311 which correspond to the current remaining amount indicator 171 that are selected by the selection operation. The change over time of the remaining amount of ink is a transition of the remaining amount of ink over an elapsed time, and it is indicated how the remaining amount of ink is varied over the predetermined time. Here, the ink cartridge 311 which corresponds to the current remaining amount indicator 171 indicates the ink cartridge 311 for which the current remaining amount indicator 171 indicates the remaining amount of ink. In the example of FIG. 15, the C (cyan) current remaining amount indicator 171 is selected by the selection operation, and the change (a remaining amount history graph 177) over time of the remaining amount of ink of the ink cartridge 311 in which C (cyan) ink is retained is displayed on the remaining amount history indicator 175. The remaining amount history indicator 175 indicates a scatter diagram (line graph), that is, the remaining amount history graph 177 in which the measurement result of the remaining amount of ink of the ink cartridge 311 that is the selection target is plotted on a graph which gives the remaining amount of ink on the vertical axis while giving time on the horizontal axis. In this manner, the remaining amount history graph 177 which is indicated by the remaining amount history indicator 175 is equivalent to plotting the content of the remaining amount data Dr.

That is, in the example in FIG. 15, the C (cyan) remaining amount history graph 177 is displayed on the remaining amount history indicator 175. However, the user is able to appropriately select the target on which the remaining amount history indicator 175 is to be displayed during execution of the history display mode. In detail, when the selection operation in which at least one out of the current remaining amount indicators 171 of each of the four colors that are displayed on the display 37 is input during execution of the history display mode, the input and output control section 517 indicates the change (remaining amount history graph 177) over time of the remaining amount of ink of the ink cartridge 311 which corresponds to the current remaining amount indicator 171 that is selected in the selection operation on the remaining amount history indicator 175. Accordingly, the user is able to display the remaining amount history graph 177 of a desired color on the remaining amount history indicator 175 by tapping the current remaining amount indicator 171 of the desired color in the history display mode.

The display range of the remaining amount history graph 177 on the remaining amount history indicator 175 initially sets the latest measurement time as the origin in a predetermined range in the past. In addition, the user is able to modify the display range of the remaining amount history graph 177 on the remaining amount history indicator 175 by inputting an enlargement and shrinking operation with respect to display 37. In detail, it is possible to enlarge or shrink the display range of the remaining amount history graph 177 on the remaining amount history indicator 175 by performing the operation (pinch-in) for narrowing or the operation (pinch-out) for widening with two fingers which touch the display 37.

In this manner, the display content on the ink status window 170 is modified from FIG. 14 to FIG. 15 accompanying switching of the display mode. The input and output control section 517 performs modification of the display content as follows. In the current display mode, each current remaining amount indicator 171 has a comparatively wide width, and is lined up in the lateral direction. As a result, a portion of the current remaining amount indicators 171 which are disposed on the right side are displayed by overlapping with the history display space S175. Meanwhile, accompanying switching of the history display mode, the current remaining amount indicators 171 in the history display mode shrink in the width direction (lateral direction) in comparison to the current remaining amount indicators 171 in the current display mode. Thereby, in the ink status window 170, each current remaining amount indicator 171 is displayed so as to not overlap with the history display space S175, and the history display space S175 is open to the right side of the current remaining amount indicators 171 of each of the four colors. Then, the remaining amount history indicator 175 is displayed to pop up the history display space S175 which is open in this manner.

When step S203 or S204 are executed as described above, the input and output control section 517 confirms whether or not the display end request of the ink status window 170 is present (step S205). In detail, the input and output control section 517 determines whether or not the end operation is input in which a finger that touches the ink status window 170 that is displayed on the display 37 slides (flicks). Then, in a case where the input of the end operation is not confirmed, the input and output control section 517 confirms the input operation, and the process returns to step S202.

In a case where the process returns to step S202 while executing the current display mode, the input and output control section 517 executes the determination process in the same manner as described above in step S202. Meanwhile, in a case where the process returns to step S202 while the history display mode is operated, it is confirmed whether or not there is a deletion request of the history display in step S202. In detail, it is determined whether or not the deletion operation is input in which a range outside of the current remaining amount indicator 171 and the remaining amount history indicator 175 is tapped in the ink status window 170 of the history display mode which is displayed on the display 37. Then, in a case where the input of the deletion operation is confirmed, step S203 is executed, and in a case where the input of the deletion operation is not confirmed, step S204 is executed. Then, steps S202 to S204 are repeatedly executed until the input and output control section 517 has the deletion request of the ink status window 170 (until "YES" is determined in step S205).

In the embodiment as described above, the current remaining amount indicator 171 which indicates the remaining amount of ink of the ink cartridge 311 of the current time (equivalent to an example of the "specified time" of the invention), and the remaining amount history indicator 175 which indicates the change over time of the remaining amount of ink of the ink cartridge 311 are indicated on the display 37. Accordingly, the user is able to ascertain the pace of ink consumption from the change over time of the remaining amount of ink, and is able to determine whether or not it is necessary to replace the ink cartridge 311 when a certain time has elapsed from the current time based on the ascertained pace of ink consumption and the remaining amount of ink at the current time. Thereby, the replacement period of the ink cartridge 311 is able to be simply determined by the user.

In addition, the input and output control section 517 selectively executes either the current display mode in which the remaining amount history indicator 175 is not displayed while the current remaining amount indicator 171 is displayed, or the history display mode in which the current remaining amount indicator 171 and the remaining amount history indicator 175 are displayed. Thereby, in a case where display of the remaining amount history indicator 175 is unnecessary, the current display mode is executed, and in a case where display of the remaining amount history indicator 175 is necessary, the history display mode is executed, and a display control is possible according to the display necessity of the remaining amount history indicator 175.

In addition, in the history display mode, the current remaining amount indicator 171 is displayed without overlapping with the history display space S175 while the remaining amount history indicator 175 is displayed in the history display space S175 (equivalent to an example of the "predetermined range" of the invention). In addition, in the current display mode, the current remaining amount indicator 171 is displayed by overlapping with the history display space S175. With this configuration, in the history display mode, since the current remaining amount indicator 171 and the remaining amount history indicator 175 are displayed so as not to overlap with each other, it is possible to secure visibility of each of the indicators 171 and 175. Meanwhile, in the current display mode, the current remaining amount indicator 171 is displayed to overlap with the history display space S175. Accordingly, in the current display mode, it is possible to effectively utilize the history display space S175 in the display of the current remaining amount indicator 171.

In addition, in the history display mode, the input and output control section 517 displays the current remaining amount indicator 171 to be shrunk more than in the current display mode. With this configuration, in the current display mode, it is possible to improve visibility of the current remaining amount indicator 171 by displaying the current remaining amount indicator 171 to be large, and in the history display mode, it is possible to improve visibility of the remaining amount history indicator 175 by securing the display range (history display space S175) of the remaining amount history indicator 175.

In addition, the touch panel on the display 37 receives the selection operation of the user who selects one current remaining amount indicator 171 out of the plurality of current remaining amount indicators 171 during display in the current display mode. Then, the input and output control section 517 performs switching from the current display mode to the history display mode when the selection operation is input to the touch panel on the display 37 to display the change over time of the remaining amount of ink in the ink cartridge 311 which corresponds to the one current remaining amount indicator 171 which is selected in the selection operation using the remaining amount history indicator 175. With this configuration, the user is able to confirm by displaying the remaining amount history indicator 175 which indicates the change over time of the remaining amount of ink in the desired ink cartridge 311 on the display 37 by performing the selection operation in which the current remaining amount indicator 171, that corresponds to the ink cartridge 311 for which the change over time of the remaining amount of ink is desired to be known, is selected during display in the current display mode.

In this manner, in the embodiment, the printer 1A is equivalent to an example of the "printer" of the invention, the printing control section 511 is equivalent to an example of the "printing executing section" of the invention, the display 37 is equivalent to an example of the "display section" or the "input operation section" of the invention, the ink cartridge 311 is equivalent to an example of the "cartridge" of the invention, the input and output control section 517 is equivalent to an example of the "display control section" of the invention, the current remaining amount indicator 171 is equivalent to an example of the "first indicator" of the invention, the remaining amount history indicator 175 is equivalent to an example of the "second indicator" of the invention, the current display mode is equivalent to an example of the "first mode" of the invention, and the history display mode is equivalent to an example of the "second mode" of the invention.

Here, the present invention is not limited to the embodiments described above, and it is possible to add various modifications with regard to the above description without deviating from the gist of the present invention. Accordingly, for example, the display form in the ink status window 170 in the history display mode may be appropriately modified. Subsequently, the modification examples will be described. Here, below, the points of difference from the embodiments are mainly described, and description of common points is omitted as appropriate. However, needless to say the same effects are exhibited by providing a configuration which is common to the embodiments.

Figure 16:
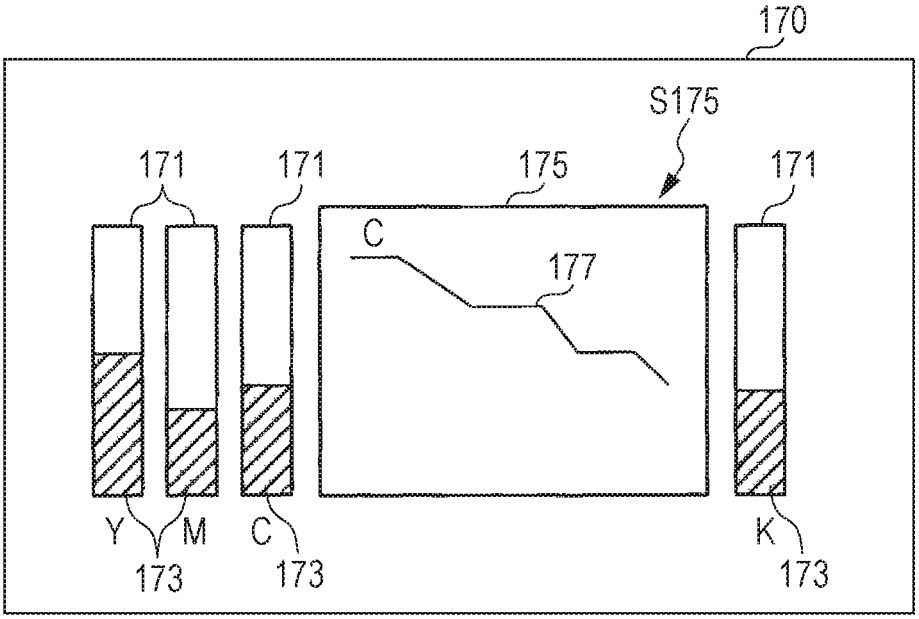
FIG. 16 is a diagram illustrating a first modification example of an ink status window in the history display mode.

FIG. 16 is a diagram illustrating a first modification example of a display form of an ink status window in the history display mode. In the modification example in FIG. 16, when the selection operation is executed, the input and output control section 517 enlarges a distance between the selection target current remaining amount display bar 173 and the current remaining amount display bar 173 which is adjacent to the selection target, and the history display space S175 is provided therebetween. Then, the remaining amount history indicator 175 is displayed in the history display space S175.

Figure 17:
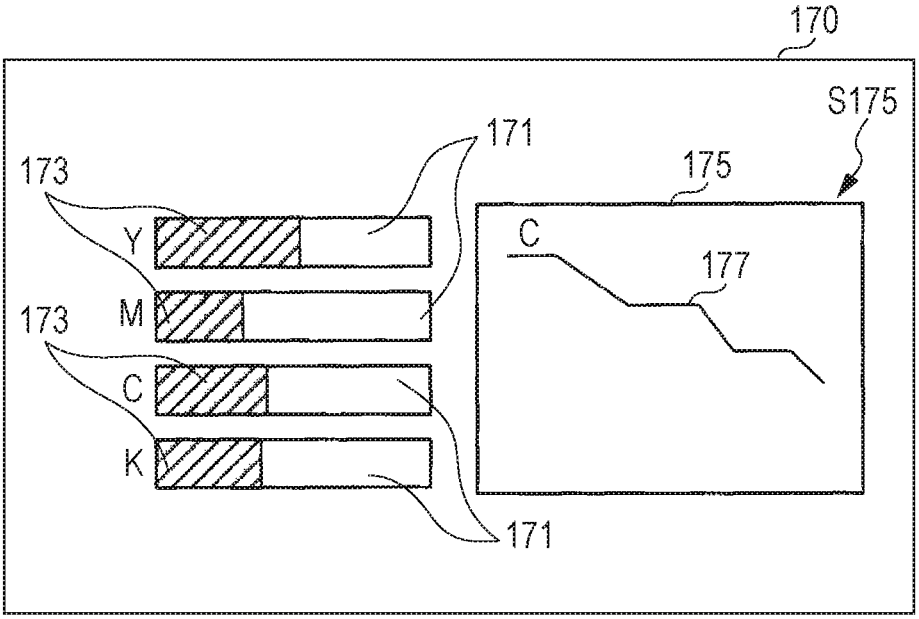
FIG. 17 is a diagram illustrating a second modification example of the ink status window in the history display mode.

FIG. 17 is a diagram illustrating a second modification example of a display form of an ink status window in the history display mode. In the modification example in FIG. 17, the current remaining amount indicator 171 is displayed horizontally, and the current remaining amount display bar 173 of the current remaining amount indicator 171 expands and contracts horizontally according to the remaining amount of ink in the corresponding ink cartridge 311.

Figure 18:
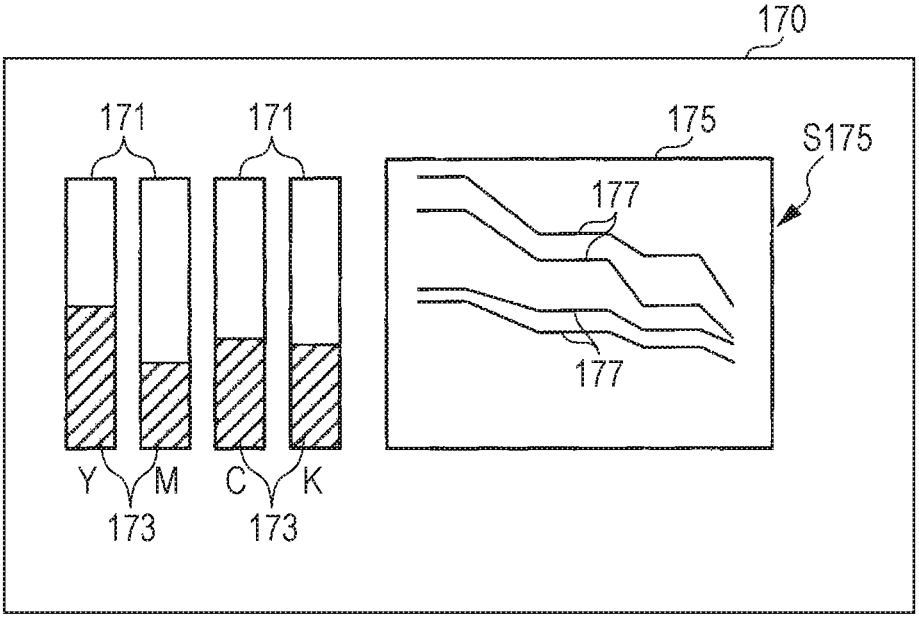
FIG. 18 is a diagram illustrating a third modification example of an ink status window in the history display mode.

FIG. 18 is a diagram illustrating a third modification example of a display form of an ink status window in the history display mode. In the modification example in FIG. 18, the remaining amount history graph 177 of the four colors are displayed in the remaining amount history indicator 175. In the modification example, the input and output control section 517 monitors the presence or absence of the switching operation in which switching of the display mode is requested in step S202 (FIG. 13) in which switching from the current display mode to the history display mode is determined. In detail, the input and output control section 517 determines whether or not the switching operation in which at least one location on the ink status window 170 is tapped is input on the touch panel on the display 37 by the user. Then, in a case where the input of the switching operation is not confirmed, the process proceeds to step S203. Meanwhile, in a case where it is possible to confirm the input of the switching operation, the process proceeds to step S204 and the ink status window 170 of FIG. 18 is displayed on the display 37. With this configuration, it is possible for the user to execute switching from the current display mode to the history display mode at an arbitrary timing in order to confirm the change over time of the remaining amount of ink.

Here, it is possible to include the result of the print job of a plurality of times which is executed in the past in the remaining amount history graph 177 which indicates the remaining amount history indicator 175 by appropriately widening the display range. For example, the remaining amount history graph 177 which is illustrated in FIG. 16 includes three print jobs (in the example in FIG. 16, the print job is executed at the location at which the remaining amount of ink is reduced). At this time, the input and output control section 517 may have a different display form (for example, line style, color, thickness, and the like) of the remaining amount history graph 177 in each print job. With this configuration, it is possible for the user to simply ascertain the pace of consumption of ink in each print job based on the difference of the display forms. Accordingly, it is possible for the user to more precisely ascertain a period at which it is necessary to replace the ink cartridge 311 accompanying the print job which is subsequently executed.

In addition, aside from each display mode described above, the input and output control section 517 may be configured such that it is possible to execute a mode in which only the remaining amount history indicator 175 is indicated on a separate window from the current remaining amount indicator 171. With this configuration, for example, it is possible to simply enlarge the display of the remaining amount history indicator 175 by displaying (displaying on the entire screen) the ink status window 170 which indicates the remaining amount history indicator 175 on the entire surface of the display 37. As a result, it is convenient in a case in which it is desired to confirm details of the remaining amount history indicator 175 and the like.

In addition, in the history display mode described above, it is also possible to configure such that only the remaining amount history indicator 175 is displayed on the ink status window 170, and the current remaining amount indicator 171 is not displayed. With this configuration, the current remaining amount indicator 171 (current display mode) which indicates the remaining amount of ink of the ink cartridge 311 at the current time, and the remaining amount history indicator 175 (history display mode) which indicates the change over time of the remaining amount of ink of the ink cartridge 311 are displayed on the display 37 by appropriately switching the display mode. Accordingly, the user is able to ascertain the pace of ink consumption from the change over time of the remaining amount of ink, and is able to determine whether or not it is necessary to replace the ink cartridge 311 when a certain time has elapsed from the current time based on the ascertained pace of ink consumption and the remaining amount of ink at the current time. Thereby, the replacement period of the ink cartridge 311 is able to be simply determined by the user.

In addition, in the embodiments, the input operation is performed on the touch panel on the display 37, but is not limited thereto. A button or the like may be selected and operated by an operation section which is provided separately, and the button operation is performed.

In addition, various modifications to the display form of the current display mode are possible. Accordingly, in the ink status window 170 in the current display mode, for example, the current remaining amount display bar 173 may be expanded and contracted horizontally according to the remaining amount of ink by horizontally displaying the current remaining amount indicator 171.

In addition, in the printer 1A which is provided with the maintenance unit 35 as described above, maintenance is appropriately executed. Then, in the maintenance, ink is consumed in order to appropriately execute suction of ink from the printing head 33. Therefore, when the remaining amount of ink is measured, the consumption of ink accompanying maintenance may also be considered. That is, in a case where the ink is consumed by maintenance, the remaining amount of ink may be reduced by the consumed portion. That is, in a case where a liquid surface of ink is detected by a sensor, ink consumption accompanying maintenance may be obtained from a detection value of the sensor. Meanwhile, in a configuration in which the amount of ink which is used in printing is calculated from the print job, the amount of ink consumption accompanying maintenance is not limited to being able to be directly obtained. In this case, for example, a result may be used which directly obtains ink consumption, in advance, accompanying maintenance.

In addition, when the remaining amount of ink is measured, the amount which is evaporated over an elapsed time may be considered. The amount which is evaporated over an elapsed time may be calculated by adding a value that is calculated from a value in which the amount of ink consumption is calculated from the print job or a value in which the actual amount of ink which is discharged is counted, and the amount of ink consumption accompanying maintenance.

In addition, an attachable and detachable ink cartridge as an ink retaining section is described as an example, but is not limited thereto. There may be a configuration in which ink is refillable with respect to a tank which is able to retain ink. Here, even if fixed, the tank may be attachable and detachable.

Figure 19:
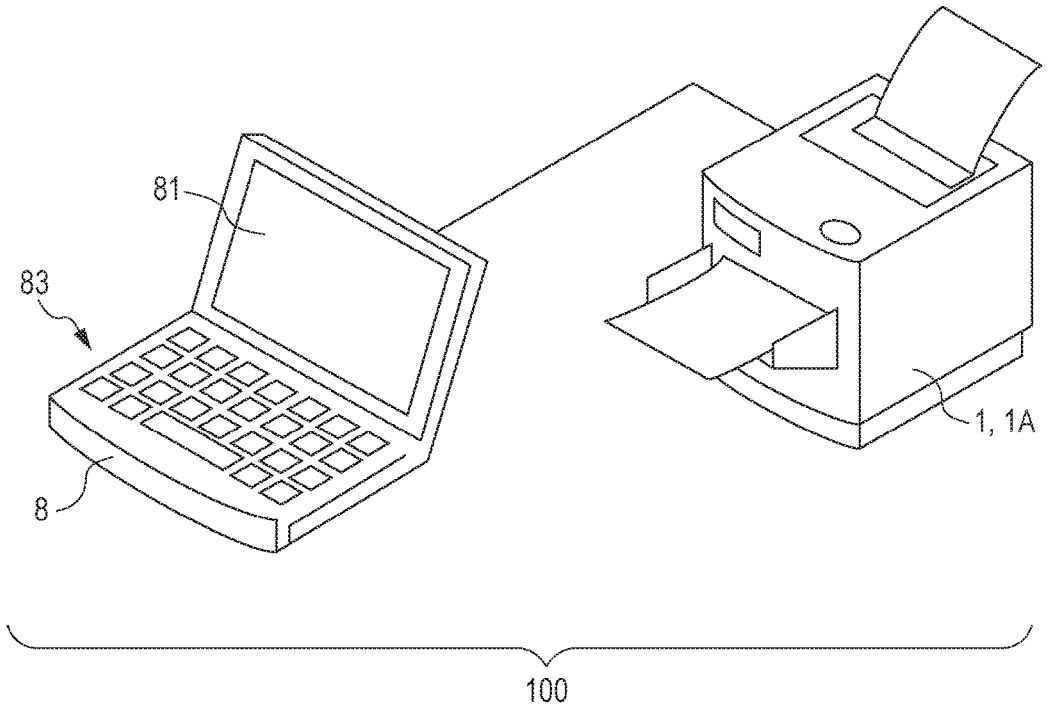
FIG. 19 is a diagram illustrating a configuration of a printing system to which the invention can be applied.

In addition, in the first embodiment and the second embodiment described above, the function of the controllers 5 and 5A is built into the printers 1 and 1A. However, as shown in FIG. 19, a portion of the controllers 5 and 5A may be provided separately from the printers 1 and 1A. FIG. 19 is a diagram illustrating a configuration of a printing system to which the invention can be applied. The printing system 100 is provided with the printers 1 and 1A and a control device 8. The control device 8 is a personal computer, and controls printing using the printers 1 and 1A by communicating with the printers 1 and 1A via wires or in a wireless manner. The printing system 100 may be configured such that out of the configuration of the controller 5 as shown in FIG. 1 and the controller 5A as shown in FIG. 11, a configuration except for the printing control section 511 is mounted in the control device 8. With this configuration, the ink status windows 7 and 170 are displayed on a display 81 of the control device 8, and the input operation is executed by the user with respect to the input and output control section 517 (refer to FIGS. 1 and 11) via an input device 83 (a keyboard, mouse, or the like) of the control device 8. That is, in FIG. 19, a case is exemplified in which the personal computer functions as the control device 8. However, a portable terminal device such as a laptop personal computer, a smartphone, a tablet, or the like may function as the control device 8.

The entire disclosure of Japanese Patent Application No.:2015-004921, filed Jan. 14, 2015 and 2015-004922, filed Jan. 14, 2015 are expressly incorporated by reference herein.

What is claimed is:

1. A remaining amount of ink display apparatus comprising:

a printing executing section configured to execute printing by discharging ink from a plurality of retaining sections;

a consumption amount acquiring section configured to independently set respective reference times for at least two retaining sections of the plurality of retaining sections, and to acquire an amount of ink consumed since the respective reference times for each of the two retaining sections;

a remaining amount acquiring section configured to acquire a remaining amount of ink in the two retaining sections;

a display section configured to display information to a user; and a display control section configured to cause the display section to display the amount of ink consumption and the remaining amount of ink in the two retaining sections on the display section.

2. The remaining amount of ink display apparatus according to claim 1, further comprising:

an input operation section configured to receive an input operation, wherein the consumption amount acquiring section is configured to set at least one of the reference times according to the content of the input operation received by the input operation section.

3. The remaining amount of ink display apparatus according to claim 2, wherein the consumption amount acquiring section is configured to set the reference times to timings which are different from each other.

4. The remaining amount of ink display apparatus according to claim 1, wherein the consumption amount acquiring section is further configured to set common reference times for at least two retaining sections out of the plurality of retaining sections.

5. The remaining amount of ink display apparatus according to claim 1, wherein the consumption amount acquiring section set the reference times according to the content of the print job.

6. A remaining amount of ink display apparatus comprising:

a printing executing section configured to execute printing by discharging ink that is retained in at least one retaining section, a display section configured to display information, and a display control section configured to:

cause the display section to display a first indicator which indicates a remaining amount of ink of the at least one retaining section at specified times, a second indicator which indicates a change over time of the remaining amount of ink of the at least one retaining section, and a remaining amount history graph;

selectively execute at least one of a first mode in which the second indicator is not displayed while the first indicator is displayed, and a second mode in which the first indicator and the second indicator are displayed simultaneously; and display the second indicator responsive to a switch from the first mode to the second mode.

7. The remaining amount of ink display apparatus according to claim 6, wherein in the second mode, the first indicator is displayed outside a predetermined display area of the display section while the second indicator is displayed in the predetermined display area, and in the first mode, the second indicator is not displayed while the first indicator is displayed in the predetermined display area.

8. The remaining amount of ink display apparatus according to claim 7, wherein the display control section is configured to cause the display section to display the first indicator as smaller in the second mode than in the first mode.

9. The remaining amount of ink display apparatus according to claim 6, wherein the at least one retaining section comprises a plurality of retaining sections, and the display control section is configured to cause the display section to display a plurality of the first indicators, which respectively indicate the remaining amount of ink of different retaining sections of the plurality of retaining sections, in the first mode.

10. The remaining amount of ink display apparatus according to claim 9, further comprising:

an input operation section configured to receive a selection operation in which one first indicator is specified from the plurality of first indicators during display in the first mode, wherein the display control section is configured to cause the display section to display a change over time of the remaining amount of ink in the at least one retaining section which corresponds to the one first indicator selected in the selection operation using the second indicator by switching from the first mode to the second mode when the selection operation is input to the input operation section.

11. A remaining amount of ink display apparatus comprising:

a printing executing section configured to execute printing based on a print job by discharging ink from a retaining section;

a consumption amount acquiring section configured to set a reference time according to a content of the print job, and to acquire an amount of ink consumed from the retaining section by printing executed at the reference time or after as an amount of ink consumption;

a remaining amount acquiring section configured to acquire a remaining amount of ink in the retaining section;

a display section configured to display information to a user; and a display control section configured to cause the display section to display the amount of ink consumption and the remaining amount of ink.

12. The remaining amount of ink display apparatus according to claim 11, further comprising:

an input operation section configured to receive an input operation, wherein the consumption amount acquiring section is configured to set the reference time according to the content of the input operation of the input operation section.

13. The remaining amount of ink display apparatus according to claim 11, wherein the consumption amount acquiring section is configured to set the reference times according to a timing at which printing is started, when a number of sheets to be printed in the print job is a predetermined number or more.

14. The remaining amount of ink display apparatus according to claim 11, wherein the consumption amount acquiring section is configured to set the reference time according to a timing at which printing is started, when ink of a specific color is specified in the print job.

* * * * *